US009215912B2

(12) United States Patent
Kondo

(10) Patent No.: US 9,215,912 B2
(45) Date of Patent: Dec. 22, 2015

(54) SLIDING FASTENER

(75) Inventor: Yuji Kondo, Toyama (JP)

(73) Assignee: YKK Corporation (JP)

( * ) Notice: Subject to any disclaimer, the term of this patent is extended or adjusted under 35 U.S.C. 154(b) by 226 days.

(21) Appl. No.: 13/880,735

(22) PCT Filed: Nov. 1, 2010

(86) PCT No.: PCT/JP2010/069441
§ 371 (c)(1),
(2), (4) Date: Apr. 21, 2013

(87) PCT Pub. No.: WO2012/059972
PCT Pub. Date: May 10, 2012

(65) Prior Publication Data

US 2013/0205550 A1 Aug. 15, 2013

(51) Int. Cl.
*A44B 19/26* (2006.01)
*A44B 19/04* (2006.01)

(52) U.S. Cl.
CPC ..... *A44B 19/26* (2013.01); *A44B 19/04* (2013.01); *Y10T 24/2582* (2015.01)

(58) Field of Classification Search
CPC ..... A44B 19/02; A44B 19/04; A44B 19/06; A44B 19/26; Y10T 24/2539; Y10T 24/2543; Y10T 24/2548; Y10T 24/255; Y10T 24/2552; Y10T 24/2554; Y10T 24/2555; Y10T 24/2557; Y10T 24/2559; Y10T 24/2561; Y10T 24/2582
USPC ..... 24/403, 405, 408–414
See application file for complete search history.

(56) References Cited

U.S. PATENT DOCUMENTS 4,263,698 A * 4/1981 Moertel ..... A44B 19/06 24/412
7,337,509 B2 * 3/2008 Kondo et al. ..... 24/405
2006/0130292 A1 6/2006 Kondo et al.

FOREIGN PATENT DOCUMENTS

JP 2006-167191 A 6/2006

OTHER PUBLICATIONS

International Search Report, PCT Application No. PCT/JP2010/069441, mailed Feb. 15, 2011.

* cited by examiner

*Primary Examiner* — Abigail Morrell
(74) *Attorney, Agent, or Firm* — Kilpatrick Townsend & Stockton LLP

(57) ABSTRACT

In a sliding fastener, a fastener element is adhered at a predetermined pitch. The fastener element includes: a close-contact portion; and first and second engaging/disengaging portions which are respectively disposed on the first and the second tape surface sides of the close-contact portion. The close-contact portion has a first close-contact surface and a second close-contact surface which are respectively disposed in one direction and the other direction along the tape length direction. In addition, the pitch is set smaller than a sum of a dimension between the first and the second close-contact surfaces and a dimension between the first and the second close-contact surfaces. As a result, it is possible to make an element row rigid in a line in a more firm manner when a left and right element rows are coupled.

5 Claims, 17 Drawing Sheets

SLIDING FASTENER

This application is a national stage application of PCT/JP2010/069441 which is incorporated herein by reference.

TECHNICAL FIELD

The invention relates to a sliding fastener which has the same flexibility as the related art in a state of a single fastener stringer where the fastener elements are separated, and on the other hand which makes the element rows rigid in a state of a fastener chain where the fastener elements are coupled and thus retains a linear state without bending the fastener chain.

BACKGROUND ART

In JP 2006-167191 A (Patent Document 1), there is disclosed a sliding fastener which can make the element rows rigid at the time of coupling as described above.

A sliding fastener 61 disclosed in Patent Document 1 includes, as illustrated in FIGS. 16 and 17, left and right fastener stringers 62 to which a number of fastener elements 70 are adhered along corresponding tape side edges of a pair of left and right fastener tapes 63. The fastener elements 70 are made of a thermoplastic synthetic resin material, and are integrated with the fastener tapes 63 through the injection molding of the synthetic resin material on the fastener tape 63.

Each fastener element 70 includes an element body 71 which is integrally adhered to the fastener tape 63, and a bump section 72 which is a rectangular plate shape integrally formed in the front and back surfaces of the element body 71. In addition, the element body 71 includes a base 71*a* which is fixed to the fastener tape 63, a neck portion 71*b* which is continuously connected to the base 71*a* and protrudes outward from the side edge of the fastener tape 63, and a coupling head 71*c* which further protrudes outward from the neck portion 71*b*. The element body is configured such that the coupling head 71*c* of the corresponding element body 71 to be coupled is coupled between the neck portions 71*b* of the adjacent element bodies 71 when the left and right fastener elements 70 are coupled.

In addition, a rectangular bump portion 72 disposed in each fastener element 70 has the same shape and the same dimension. The position of the end surface at one end of each rectangular bump portion 72 in the tape length direction is disposed at a position slightly shifted to the outside from an expanding end position on the coupling head 71*c* of the element body 71, and the position of the other end of each rectangular bump portion 72 in the tape length direction is disposed at a position where the neck portion 71*b* of the element body 71 becomes narrowest. In this case, the both end surfaces of the rectangular bump portion 72 in the tape length direction become first close-contact planes at a time when the fastener elements 70 are coupled.

Furthermore, a recess portion 71*d* is formed between the front and back rectangular bump portions 72, into which the coupling head 71*c* of the corresponding fastener element 70 to be coupled is fitted. With this configuration, when the left and right fastener elements 70 are coupled, the coupling head 71*c* of the element body 71 is fitted into the corresponding recess portion 71*d* to be coupled, and a portion of the coupling head 71*c* and the neck portion 71*b* of the element body 71 is interposed and comes in close contact between the facing inner surfaces which are disposed on the front and back sides of the corresponding rectangular bump portions 72 to be coupled. In this case, the facing inner surfaces of the rectangular bump portion 72 on the front side and the rectangular bump portion 72 on the back side become second close-contact planes.

In the sliding fastener 61 with the above-mentioned configurations of Patent Document 1, when the left and right fastener elements 70 are coupled, the first close-contact planes (both end surfaces in the tape length direction) of the rectangular bump portions 72 of the left and right fastener elements 70 come in close contact with each other. In addition, in each fastener element 70, the second close-contact planes (facing inner surfaces) of a pair of the rectangular bump portions 72 come in close contact with the element body 71 to interpose the corresponding element body 71 to be coupled.

With this configuration, each fastener element 70 regulates the movement of the fastener elements 70 with respect to one another, and the fastener elements 70 are disabled from being rotated in a direction along the tape plane and in a direction perpendicular to the tape plane. As a result, it is possible to make the element rows of the sliding fastener 61 rigid in a line.

Since the sliding fastener 61 of Patent Document 1 is made rigid when the fastener elements 70 are coupled as described above, the sliding fastener can serve as a reinforcing material for making various kinds of products stable in shape by the rigidity. On the other hand, the fastener elements 70 are released from the rigidity when separated, and thus the sliding fastener 61 can be easily modified in shape together with the modification in shape of various kinds of products. Therefore, through the separation of the fastener elements 70, the sliding fastener 61 can be folded.

Accordingly, the sliding fastener 61 can serve as a member for connecting sheet materials when a tent is set up, for example, by being attached to edge portions of the sheet materials constituting the tent, and also as a reinforcing core material of the tent, so that it is possible to widely use the sliding fastener 61 in new applications.

PRIOR ART DOCUMENT

Patent Document

Patent Document 1: JP 2006-167191 A

DISCLOSURE OF THE INVENTION

Problem to be Solved by the Invention

In the sliding fastener 61 described in Patent Document 1, when the fastener element 70 is formed on the fastener tape 63 through the injection molding, the element body 71 disposed between the front and back rectangular bump portions 72 of the fastener element 70 forms an undercut portion. Therefore, a structure of a mold for forming the fastener element 70 becomes extremely complex, and thus it incurs an increase in manufacturing cost.

In addition, in a case where the fastener element 70 having the shape described above is attached to the fastener tape 63, it is considered that, for example, the fastener tape 63 is subjected to the injection molding plural times continuously, and the rectangular bump portion 72 is assembled to the element body 71 after molding the element body 71 and the rectangular bump portion 72 individually. However, since both methods make the manufacturing process complicated and increase the number of manufacturing processes, as a result, an increase in manufacturing cost is incurred.

Furthermore, in the sliding fastener 61 of Patent Document 1, in order to make the element rows rigid, the end surfaces (the first close-contact planes) of the rectangular bump portion 72 of the left and right fastener elements 70 come in close contact with each other, and the facing inner surfaces (the second close-contact planes) of a pair of the rectangular bump portions 72 of each fastener element 70 come in close contact with the corresponding element body 71 to be coupled.

However, in a case where the first and the second close-contact planes simply come in close contact to make the element rows rigid, for example, when the rigid element rows receive a bending load (for example, a thrusting force) in the tape front and back direction, the respective close-contact state of the first and the second close-contact planes are likely to be released and thus it is difficult to stably keep the element rows rigid.

Furthermore, when the element rows are made rigid, a portion of the element body 71 of each fastener element 70 is interposed and comes in close contact with the front and back rectangular bump portions 72 of the corresponding fastener element 70 to be coupled. Therefore, for example, when the rigid element rows receive the bending load in the tape front and back direction, the root portion of the element body 71 interposed between the back and front rectangular bump portions 72 is likely to be intensively stressed, and thus there is a concern that the fastener element 70 may be damaged.

The invention has been made in consideration of the above problems, and an object is to provide a sliding fastener which can be efficiently subjected to the injection molding of the fastener element without using a complex-structured mold, and can stably keep the rigid state of the element rows in a line even when the rigid element rows receive the bending load in the tape front and back direction.

Means for Solving the Problems

In order to attain the above-mentioned object, according to an aspect of the invention, there is provided a sliding fastener including, as basic configurations, a pair of left and right fastener stringers which include a plurality of fastener elements adhered to facing tape side edges of a pair of fastener tapes at a predetermined pitch, in which the left and right fastener elements come in close contact with each other when the fastener elements are coupled to make the sliding fastener rigid, in which the fastener element includes a close-contact portion which comes in close contact with a corresponding fastener element at the time of coupling, and a first engaging/disengaging portion and a second engaging/disengaging portion which are disposed on the first tape surface side and the second tape surface side of the close-contact portion and are mutually engageable and disengageable with those of the corresponding fastener element, in which the close-contact portion includes a first close-contact surface which is disposed on one side in a tape length direction, and a second close-contact surface which is disposed on the other side in the tape length direction, and in which the pitch is set to be smaller than a sum of a dimension between the first and the second close-contact surfaces at a predetermined portion of the fastener element and a dimension between the first and the second close-contact surfaces at a corresponding portion of the corresponding fastener element.

In the sliding fastener according to the invention, it is preferable that at least one of a fitted concave portion which is recessively provided in the tape length direction and a fitting convex portion which protrudes in the tape length direction is disposed in the first close-contact surface, and at least one of the fitting convex portion which is fitted into the fitted concave portion disposed in the first close-contact surface of the corresponding fastener element and the fitted concave portion which is fitted by the fitting convex portion disposed in the first close-contact surface of the corresponding fastener element is disposed in the second close-contact surface.

In addition, in the sliding fastener according to the invention, it is preferable that the first and the second close-contact surfaces are formed to be a taper surface such that a dimension of the close-contact portion in a tape length direction increases gradually as it goes to the fastener tape.

Furthermore, it is preferable that the fitted concave portion is formed such that the groove width in the tape front and back direction decreases gradually as it goes to the fastener tape, and the fitting convex portion is formed such that the dimension in the tape front and back direction increases gradually as it goes to the fastener tape.

Further, in the sliding fastener according to the invention, it is preferable that a core thread portion is disposed at a tape side edge on a side to which the fastener element of the fastener tape is adhered, and the core thread portion is configured using a fiber thread having retractility less than that of a fiber thread of the tape main portion of the fastener tape.

Next, according to another aspect of the invention, there is provided a sliding fastener including, as basic configurations, a pair of left and right fastener stringers which include a plurality of fastener elements adhered to facing tape side edges of a pair of fastener tapes at a predetermined pitch, in which the left and right fastener elements come in close contact with each other when the fastener elements are coupled to make the sliding fastener rigid, in which the fastener element includes a close-contact portion which comes in close contact with a corresponding fastener element at the time of coupling, and a first engaging/disengaging portion and a second engaging/disengaging portion which are disposed on the first tape surface side and the second tape surface side of the close-contact portion and are mutually engageable and disengageable with those of the corresponding fastener element, in which the close-contact portion includes a first close-contact surface which is disposed on one side in a tape length direction, and a second close-contact surface which is disposed on the other side in the tape length direction, in which at least one of a fitted concave portion which is recessively provided in the tape length direction and a fitting convex portion which protrudes in the tape length direction is disposed in the first close-contact surface, and in which at least one of the fitting convex portion which is fitted into the fitted concave portion disposed in the first close-contact surface of the corresponding fastener element and the fitted concave portion which is fitted by the fitting convex portion disposed in the first close-contact surface of the corresponding fastener element is disposed in the second close-contact surface.

In addition, it is preferable that the first and the second close-contact surfaces are formed to be a taper surface such that a dimension of the close contact portion in a tape length direction increases gradually as it goes to the fastener tape.

Furthermore, it is preferable that the fitted concave portion is formed such that the groove width in the tape front and back direction decreases gradually as it goes to the fastener tape, and the fitting convex portion is formed such that the dimension in the tape front and back direction increases gradually as it goes to the fastener tape.

Effect of the Invention

In the sliding fastener according to the invention, the fastener element includes a close-contact portion which comes in close contact with a corresponding fastener element at the time of coupling, and a first engaging/disengaging portion and a second engaging/disengaging portion which are disposed on the first tape surface side and the second tape surface side of the close-contact portion, and the close-contact portion includes a first close-contact surface which is disposed on one side in a tape length direction, and a second close-contact surface which is disposed on the other side in the tape length direction.

As described above, when the fastener element is configured such that the close-contact portion is interposed between the first engaging/disengaging portion and the second engaging/disengaging portion, the fastener element can be easily and efficiently formed into a fastener tape, for example, using a slide core compared with the related art, and it is possible to reduce the cost of manufacturing the sliding fastener.

In addition, the attachment pitch of the fastener elements in the sliding fastener is set to be smaller than a sum of a dimension between the first and the second close-contact surfaces at a predetermined portion of the fastener element in the tape length direction and a dimension between the first and the second close-contact surfaces at a corresponding portion of the corresponding fastener element to be coupled, in the tape length direction.

With the attachment pitch of the fastener elements as above, when the left and right fastener elements are coupled, the first and the second engaging/disengaging portions of the left and right fastener elements are coupled to each other while the close-contact portion of the fastener element is outstretched between the close-contact portions of the adjacent corresponding fastener elements to be coupled, so that the fastener elements can be coupled.

Therefore, when the left and right fastener elements are coupled, using the retractility of the fastener tape, the close-contact portion of each fastener element can come into press contact between the close-contact portions of the adjacent corresponding fastener element to be coupled. As described above, since the left and right fastener elements come into press contact with each other to be coupled and thus the press-contact force is being applied between the left and right fastener elements, the element rows can be made rigid in a line in a more firm manner compared with the case where the left and right fastener elements simply come in close contact with each other to be coupled.

Therefore, even in a case where the rigid element rows receive a bending load in the tape front and back direction, the element rows can be stably kept rigid in a line since the press-contact force is applied on the close-contact portion of each fastener element. In addition, when the element rows are stably kept rigid in a line even in a case where the element rows receive the bending load in the tape front and back direction as described above, it is possible to prevent the stress from being intensively applied on a portion of the fastener element, so that the fastener element is hardly damaged.

In the sliding fastener of the invention, at least one of a fitted concave portion which is recessively provided in the tape length direction and a fitting convex portion which protrudes in the tape length direction is disposed in the first close-contact surface of the close-contact portion, and at least one of the fitting convex portion which is fitted into the fitted concave portion disposed in the first close-contact surface of the corresponding fastener element and the fitted concave portion which is fitted by the fitting convex portion disposed in the first close-contact surface of the corresponding fastener element is disposed in the second close-contact surface of the close-contact portion.

With this configuration, when the left and right fastener elements are coupled, the fitting convex portion disposed on the close-contact portion of the fastener element can be fitted into the fitted concave portion disposed in the corresponding fastener element to be coupled, so that the rigid state of the element rows are reinforced and thus the rigidity of the element rows against the bending load in the tape front and back direction can be increased.

In addition, according to the sliding fastener of the invention, the first and the second close-contact surfaces of the close-contact portion are formed to be a taper surface such that a dimension of the close contact portion in the tape length direction increase gradually as it goes to the fastener tape. With this configuration, when the fastener element is formed on the fastener tape, the taper shape of the first and the second close-contact surfaces of the close-contact portion can be used as a draft, so that it is possible to smoothly perform a stripping process after molding.

Moreover, since the first and the second close-contact surfaces of the close-contact portion are formed in the taper shape, the close-contact portion of the fastener element is reliably introduced between the close contact portions of the adjacent corresponding fastener element to be coupled, so that the left and right fastener elements can be smoothly coupled and the close-contact portions of the left and right fastener elements can come stably into press contact with each other.

Furthermore, according to the sliding fastener of the invention, the fitted concave portion is formed such that the groove width in the tape front and back direction decreases gradually as it goes to the fastener tape; in other words, a first inner wall surface and a second inner wall surface of the fitted concave portion are formed in the taper shape such that the groove width of the fitted concave portion decreases gradually as it goes to the fastener tape. In addition, the fitting convex portion is formed such that the dimension in the tape front and back direction increases gradually as it goes to the fastener tape; in other words, a first outer wall surface and a second outer wall surface of the fitting convex portion are formed in the taper shape such that the height of the fitting convex portion in the tape front and back direction increases gradually as it goes to the fastener tape.

With this configuration, when the fastener element is formed on the fastener tape, the first and the second inner wall surfaces of the fitted concave portion and the first and the second outer wall surfaces of the fitting convex portion can be used as drafts, so that it is possible to smoothly perform a stripping process after molding. Moreover, when the left and right fastener elements are coupled, the fitting convex portion of the fastener element can be smoothly inserted into the fitted concave portion of the corresponding fastener element to be coupled. Furthermore, when the fitting convex portion is fitted into the corresponding fitted concave portion to be coupled, the first and the second outer wall surfaces of the fitting convex portion can stably come into press contact with the first and the second inner wall surfaces of the fitted concave portion.

According to another aspect of the sliding fastener of the invention, the fastener element includes a close-contact portion which comes in close contact with a corresponding fastener element at the time of coupling, and a first engaging/disengaging portion and a second engaging/disengaging portion which are disposed on the first tape surface side and the second tape surface side of the close-contact portion. The close-contact portion includes a first close-contact surface which is disposed on one side in a tape length direction, and a second close-contact surface which is disposed on the other side in the tape length direction.

As described above, when the fastener element is configured such that the close-contact portion is interposed between the first engaging/disengaging portion and the second engaging/disengaging portion, the fastener element can be easily and efficiently formed on the fastener tape, for example, using a slide core compared with the related art, and it is possible to reduce the cost of manufacturing the sliding fastener.

In addition, in the sliding fastener, at least one of a fitted concave portion which is recessively provided in the tape length direction and a fitting convex portion which protrudes in the tape length direction is disposed in the first close-contact surface of the close-contact portion, and at least one of the fitting convex portion which is fitted into the fitted concave portion disposed in the first close-contact surface of the corresponding fastener element and the fitted concave portion which is fitted by the fitting convex portion disposed in the first close-contact surface of the corresponding fastener element is disposed in the second close-contact surface of the close-contact portion.

With this configuration, when the left and right fastener elements are coupled, the close-contact portion of each fastener element can come into press contact between the close-contact portions of the adjacent corresponding fastener elements to be coupled, and the fitting convex portion disposed on the close-contact portion of each fastener element can be fitted into the fitted concave portion disposed in the corresponding fastener element to be coupled. Therefore, the element rows can be made rigid in a line in a more firm manner compared with the case where the left and right fastener elements simply come in close contact to be coupled, and the rigidity of the element rows against the bending load in the tape front and back direction can be increased.

In addition, according to the sliding fastener of the invention, the first and the second close-contact surfaces of the close-contact portion are formed to be a taper surface such that a dimension of the close-contact portion in the tape length direction increase gradually as it goes to the fastener tape. With this configuration, when the fastener element is formed on the fastener tape, the taper shape of the first and the second close-contact surfaces of the close-contact portion can be used as a draft, so that it is possible to smoothly perform a stripping process after molding.

Moreover, since the first and the second close-contact surfaces of the close contact portion are formed in the taper shape, the close-contact portion of the fastener element is reliably introduced between the close-contact portions of the adjacent corresponding fastener element to be coupled, so that the left and right fastener elements can be smoothly coupled and the close-contact portions of the left and right fastener elements can stably come into press contact with each other.

Furthermore, according to the sliding fastener of the invention, the fitted concave portion is formed such that the groove width in the tape front and back direction decreases gradually as it goes to the fastener tape; in other words, a first inner wall surface and a second inner wall surface of the fitted concave portion are formed in the taper shape such that the groove width of the fitted concave portion decreases gradually as it goes to the fastener tape. Also, the fitting convex portion is formed such that the dimension in the tape front and back direction increases gradually as it goes to the fastener tape; in other words, a first outer wall surface and a second outer wall surface of the fitting convex portion are formed in the taper shape such that the height of the fitting convex portion in the tape front and back direction increases gradually as it goes to the fastener tape.

With this configuration, when the fastener element is formed on the fastener tape, the first and the second inner wall surfaces of the fitted concave portion and the first and the second outer wall surfaces of the fitting convex portion can be used as drafts, so that it is possible to smoothly perform a stripping process after molding. Moreover, when the left and right fastener elements are coupled, the fitting convex portion of the fastener element can be smoothly inserted into the fitted concave portion of the corresponding fastener element to be coupled. Furthermore, when the fitting convex portion is fitted into the corresponding fitted concave portion to be coupled, the first and the second outer wall surfaces of the fitting convex portion can stably come into press contact with the first and the second inner wall surfaces of the fitted concave portion.

MODE(S) FOR CARRYING OUT THE INVENTION

Hereinafter, best modes for carrying out the invention will be described in detail using embodiments with reference to the drawings. Further, the invention is not limited to the embodiments to be described below, but various changes can be made as long as the configurations are substantially equal to those in the invention and the similar operational advantages can also be obtained.

For example, the below-mentioned embodiments will be described in connection with a sliding fastener which is configured such that fastener elements made of a synthetic resin material are subjected to an injection molding process to be adhered to element attaching portions of fastener tapes facing to each other. However, the invention is not limited to the above configuration, and can be similarly applied to a sliding fastener which is configured such that fastener elements made of a metal material are subjected to a die casting process to be adhered to the fastener tapes.

Embodiment 1

Figure 1:
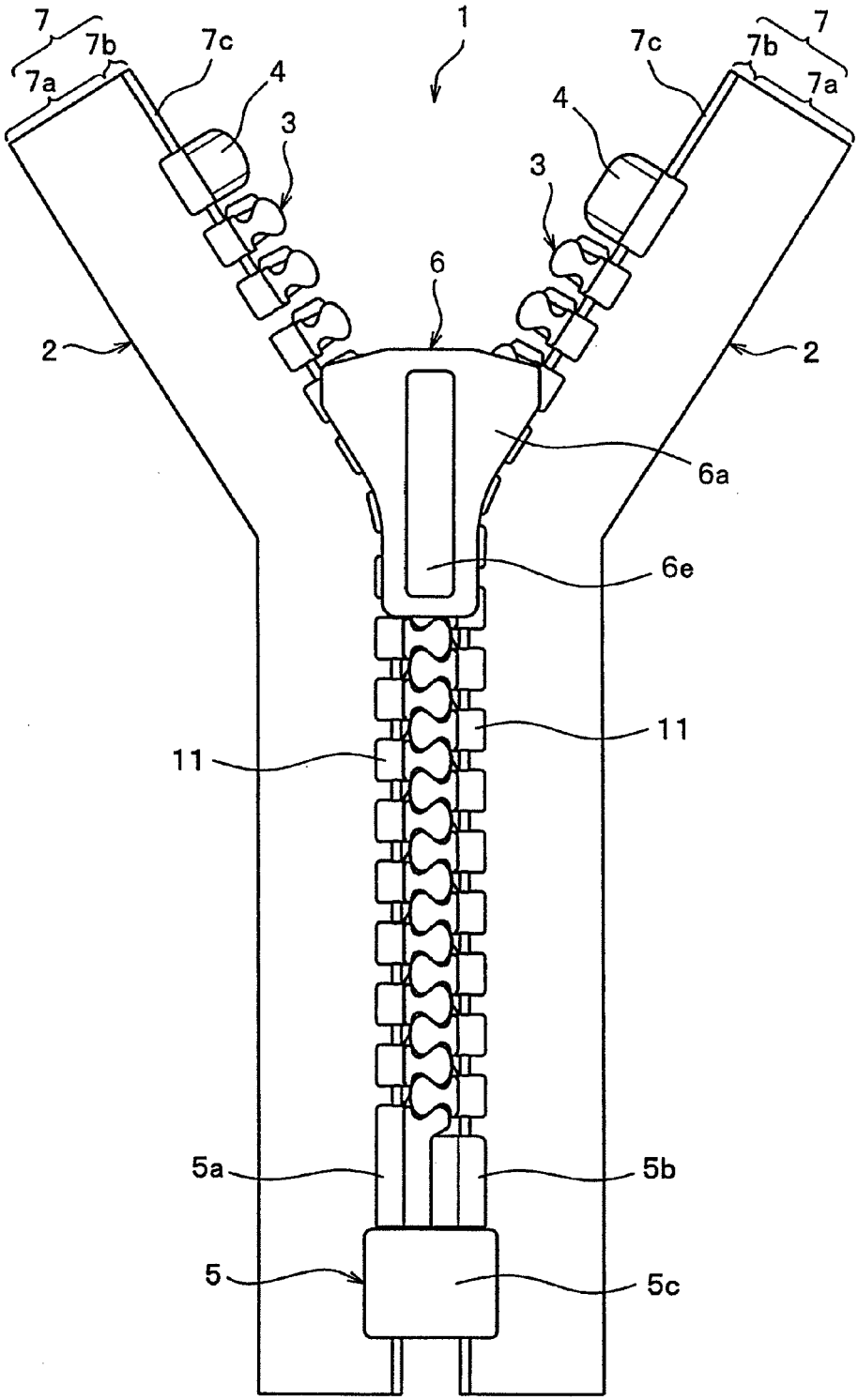
FIG. 1 is a front view illustrating a sliding fastener according to Embodiment 1 of the invention.
Figure 2:
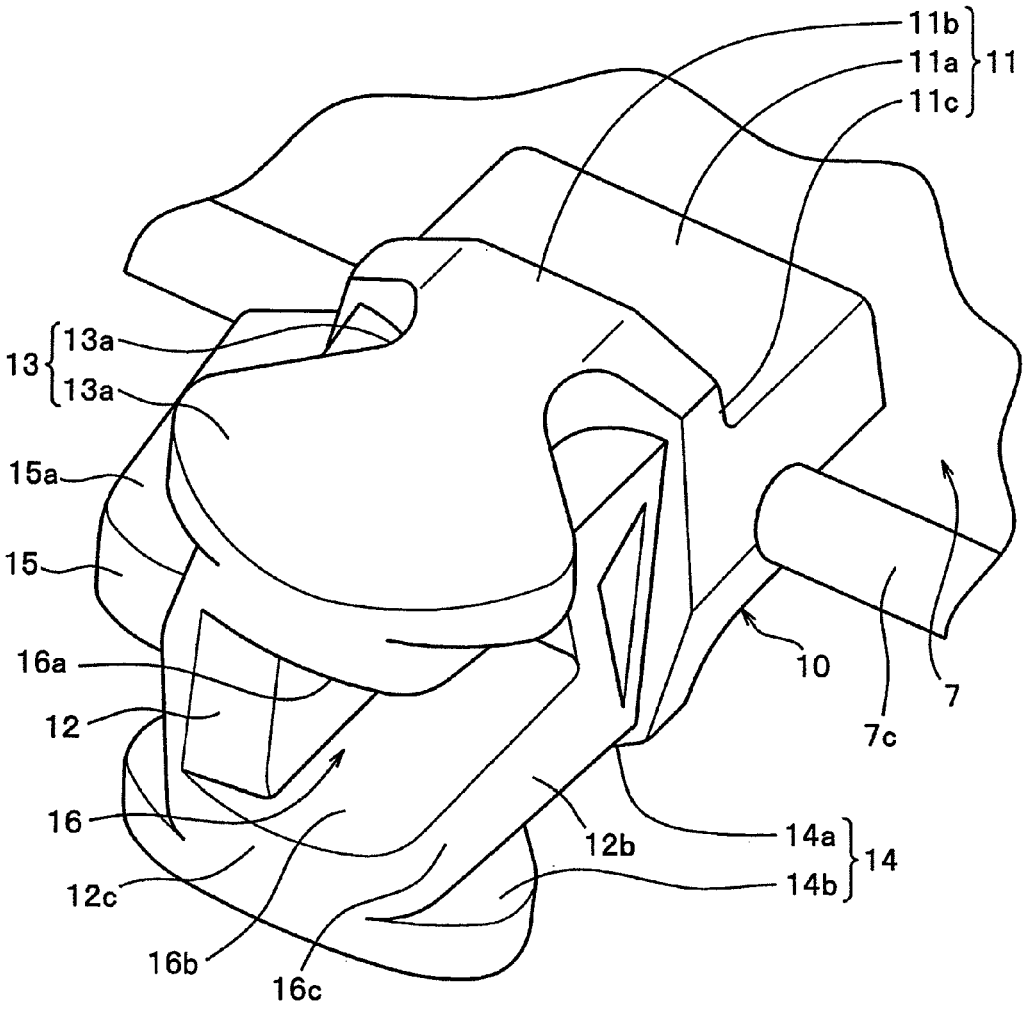
FIG. 2 is a perspective view illustrating a fastener element of the sliding fastener.
Figure 3:
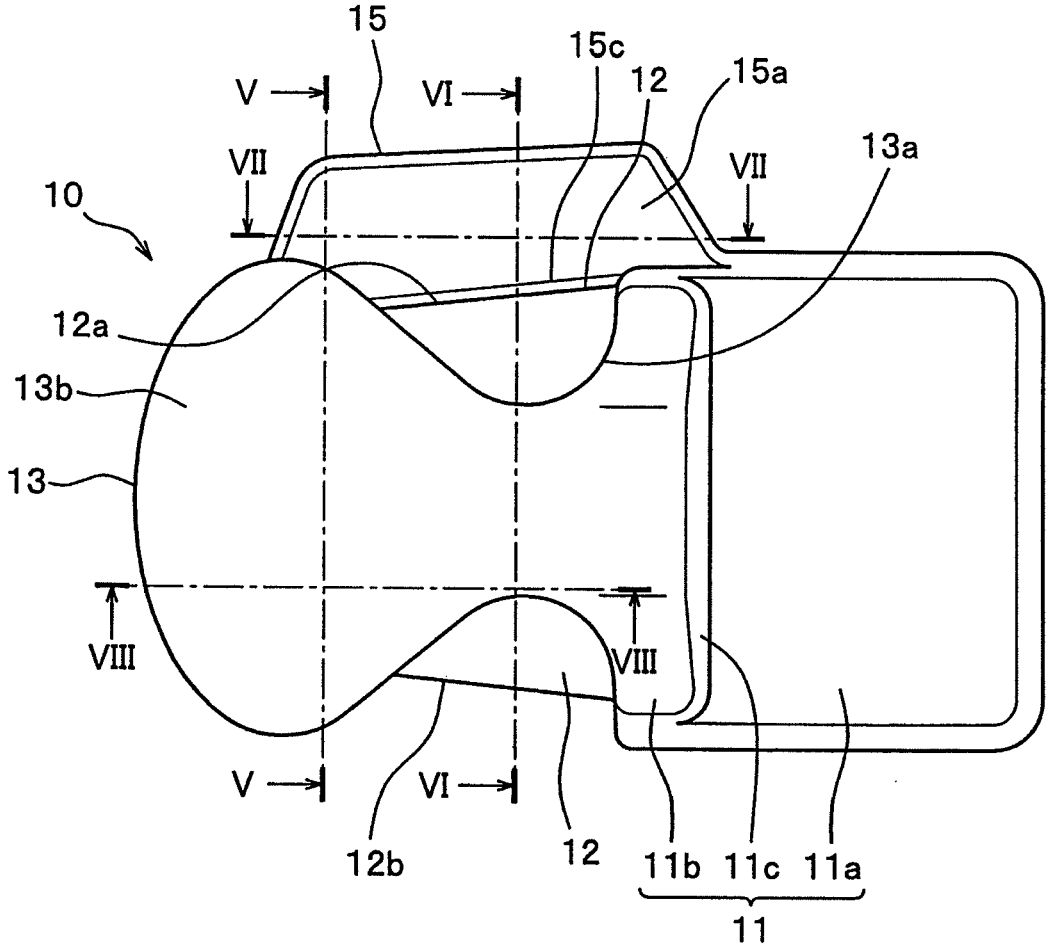
FIG. 3 is a front view illustrating the fastener element.
Figure 4:
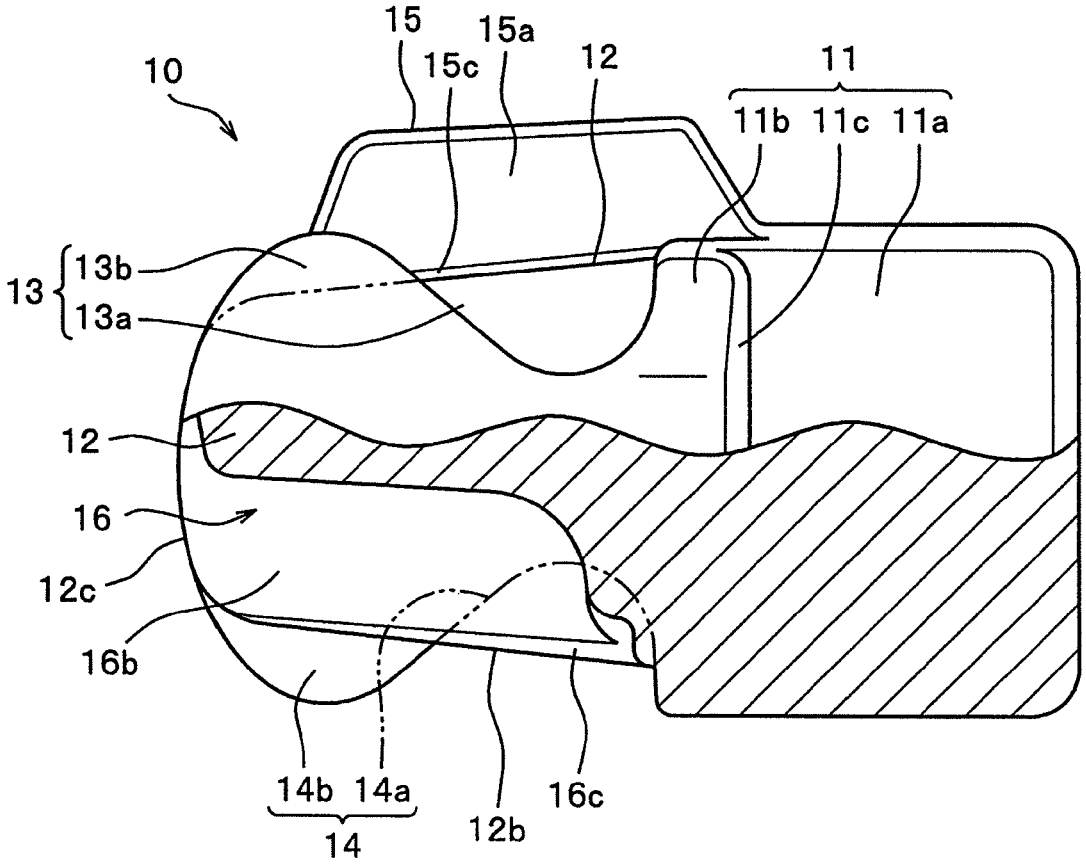
FIG. 4 is a cross-sectional view partially illustrating the fastener element.

FIG. 1 is a front view illustrating a sliding fastener according to Embodiment 1 of the invention. FIG. 2 is a perspective view illustrating a fastener element of the sliding fastener. In addition, FIGS. 3 and 4 are a front view and a cross-sectional view partially illustrating the fastener element, respectively.

Further, in the following description, it will be assumed that the tape length direction of the fastener tape is defined as a front and rear direction, and specifically the direction of a slider sliding to couple left and right element rows is defined as a front direction and the direction of the slider sliding to separate the element rows is defined as a rear direction. In addition, it will be assumed that the tape width direction of the fastener tape is defined as a left and right direction, and the left side and the right side of the sliding fastener in front view as illustrated in FIG. 1 are defined as a left side and a right side, respectively. Furthermore, it will be assumed that the front and back direction of the fastener tape is defined as an upper and lower direction, and one side of the fastener tape on which a tab of the slider is disposed is defined as an upper side and the other side opposite thereto is defined as a lower side.

A sliding fastener 1 according to Embodiment 1 includes a pair of left and right fastener stringers 2 each provided with an element row 3, top stops 4 which are adhered to the front end portions of the left and right fastener stringers 2 along the element rows 3, a separable-inserting bottom end stop 5 which is adhered to the rear end portion of the left and right fastener stringers 2, and a slider 6 which is slidably disposed along the element rows 3.

Further, the top stops 4 and the separable-inserting bottom end stop 5 included in the sliding fastener 1 of Embodiment 1 have the substantially similar configurations to those of the top stops and the separable-inserting bottom end stop which are typically used in the related art.

In other words, the top stops 4 of Embodiment 1 are configured in a shape and a dimension for the contact with a part of the slider 6 to stop the slider 6 from sliding, so that the slider 6 is prevented from dropping out of the left and right element rows 3.

In addition, the separable-inserting bottom end stop 5 is configured to include an insert pin 5*a* which is adhered to the rear end portion of the left fastener tape 7 along the element row 3, a box pin 5*b* which is adhered to the rear end portion of the right fastener tape 7 along the element row 3, and a box 5*c* which is integrally formed with the box pin 5*b* and can receive the rear end of the insert pin 5*a*.

The left and right fastener stringers 2 according to Embodiment 1 are provided with the fastener tape 7 and a plurality of fastener elements 10 made of a synthetic resin material which is adhered to the side edge of the tape facing the fastener tape 7 at a predetermined pitch, respectively.

The left and right fastener tapes 7 are woven in a narrow width strip shape using a fiber thread with less stretchability. The fastener tape 7 includes a tape main portion 7*a* which is a portion to be sewn on a fastener coating product such as a tent and an element attaching portion 7*b* which is disposed on the facing tape side edge and to which the fastener element 10 is attached. In addition, a core thread portion 7*c* is disposed at the tape edge on the side of the element attaching portion 7*b* of the fastener tape 7.

In this case, as a warp yarn which is disposed in the tape main portion 7*a* and the element attaching portion 7*b* of the fastener tape 7, except the core thread portion 7*c*, it is preferable that a fiber thread which has elongation to expand by 0.2% or more and 4.0% or less under a load of 10 kg in the lengthwise direction and has an elastic modulus to expand by 0.2% or more and 3.5% or less is used.

In addition, as at least one of fiber threads for the core thread portion 7*c*, it is preferable that a fiber thread which has elongation to expand by 0.2% or more and 4.0% or less under a load of 10 kg in the lengthwise direction and has an elastic modulus to expand by 0.2% or more and 3.5% or less is used. Specifically in this case, as at least one of fiber threads for the core thread portion 7*c*, it is preferable that a fiber thread which has retractility less than that of the warp yarn for the tape main portion 7*a* is used. Further, in the invention, the fiber threads for the fastener tape 7 are not limited in its nature, materials, fineness, and the like, and those can be arbitrarily selected according to the application of the sliding fastener 1.

In the element attaching portion 7*b* including the core thread portion 7*c* of the left and right fastener tapes 7, a plurality of the fastener elements 10 are made of a synthetic resin material through the injection molding so as to be aligned in line along the tape length direction, and these fastener elements 10 form the left and right element rows 3. Further, in the invention, the material of the fastener element 10 is not limited, and a thermoplastic synthetic resin, for example, polyacetal, polypropylene, polybutylene terephthalate, nylon, and polycarbonate may be preferably used.

In the case of Embodiment 1, the fastener elements 10 are adhered to the left and right fastener tapes 7 at a predetermined pitch (an element interval) in a plane symmetry direction. Each fastener element 10 includes a base 11 which is integrally fixed to the fastener tape 7, a close-contact portion 12 which extends from the base 11 to the corresponding fastener stringer 2, a first engaging/disengaging portion 13 which is disposed in the upper surface (a first tape surface) of the close-contact portion 12, and a second engaging/disengaging portion 14 which is disposed in the lower surface (a second tape surface) of the close-contact portion 12.

The base 11 of the fastener element 10 is integrally molded with the fastener tape 7 over the front and back surface of the tape so as to sandwich the fastener tape 7, having a substantially rectangular shape in front view. In addition, the base 11 is disposed on the inner side of the tape, and is provided with a first base 11*a* which has a height (which is a dimension in the tape front and back direction) smaller than the gap of a tape insertion groove, described below, of the slider 6, and a second base 11*b* which is disposed near the corresponding fastener stringer 2 rather than the first base 11*a* and is formed thickly in the tape front and back direction with a stepped portion 11*c*.

In addition, the height of the second base 11*b* is set to be larger than the gap of the tape insertion groove, described below, of the slider 6. The stepped portion 11*c* formed between the first and the second bases 11*a* and 11*b* of the base 11 is disposed to come into sliding contact with a flange 6*d*, described below, of the slider 6 when the slider 6 slides along the element rows 3. In this case, the upper surface and the lower surface of the second base 11*b* are disposed to be flush with the upper surface of the first engaging/disengaging portion 13 and the lower surface of the second engaging/disengaging portion 14 of the fastener elements 10, respectively.

The close contact portion 12 of the fastener element 10 of Embodiment 1 is formed to extend in a tape width direction from the base 11 toward the corresponding fastener stringer 2 to be coupled so as to be interposed by the first and the second engaging/disengaging portions 13 and 14. The close-contact portion 12 includes a first close-contact surface 12*a* which is disposed on a portion of a front surface side, a second close-contact surface 12*b* which is disposed on a portion of a rear surface side, and a tip end surface 12*c* which is disposed to face the corresponding fastener stringer 2 and is continuously formed over the range from the first close-contact surface 12*a* to the second close-contact surface 12*b*.

In addition, the first and the second close-contact surfaces 12*a* and 12*b* of the close-contact portion 12 are formed to be a taper surface inclined with respect to the tape width direction such that the dimension of the close-contact portion 12 in a tape length direction increases gradually as it goes to the fastener tape 7. In this case, the absolute values of the inclination angles at which the first and the second close-contact surfaces 12*a* and 12*b* are inclined with respect to the tape width direction are set to the same value in a range of 1° or more and 10° or less, and preferably 2° or more and 5° or less.

With this configuration, a gap (space) between the close-contact portions 12 of the fastener elements 10 adjacent to each other can be widened as it goes from the fastener tape 7 to the corresponding fastener elements 10 to be coupled. Therefore, when the left and right element rows 3 are coupled as to be described below, the close-contact portion 12 of the fastener element 10 can be smoothly inserted into the gap between the close-contact portions 12 of the corresponding adjacent fastener elements 10 to be coupled. Furthermore, since the first and the second close-contact surfaces 12*a* and 12*b* of the left and right fastener elements 10 are inclined at the same angle with respect to the tape width direction, the left and right close-contact portions 12 can stably come into press contact with each other when the left and right fastener elements 10 are coupled with each other.

In the first close-contact surface 12*a* of the close-contact portion 12, a fitting convex portion 15 is formed to protrude forward. The fitting convex portion 15 is disposed on the center portion of the close-contact portion 12 in the tape front and back direction. Further, the fitting convex portion 15 is disposed over a range of the first close-contact surface 12*a* and the front end surface of the base 11, as illustrated in FIG. 3. The left and right end edges of the fitting convex portion 15 are formed such that the dimension of the fitting convex portion 15 in the tape width direction decreases gradually as it goes from the base end portion of the fitting convex portion 15 facing the first close-contact surface 12*a* to the front end edge.

In addition, the front end edge of the fitting convex portion 15 is disposed with an inclination in the tape width direction in front view (see FIG. 3) so as to be pulled up forward as it goes near the fastener tape 7. Furthermore, an upper surface 15*a* and a lower surface 15*b* of the fitting convex portion 15 are disposed in a taper shape inclined in the direction of tape width with respect to the tape surface of the fastener tape 7 so that the height of the fitting convex portion 15 in the upper and lower direction increases gradually as it goes to the fastener tape 7 (see FIG. 7).

In addition, in the base end portion of the fitting convex portion 15, a root portion 15*c* is disposed which has an increasing height in the upper and lower direction of the fitting convex portion 15 as it goes near the first close-contact surface 12*a* so that the surface of the element is formed with relative smoothness over a range from the upper surface 15*a* and the lower surface 15*b* of the fitting convex portion 15 to the first close-contact surface 12*a*.

On the other hand, in the second close-contact surface 12*b* of the close contact portion 12, a fitted concave portion 16 is recessively provided to which the fitting convex portion 15 disposed at the corresponding fastener element 10 to be coupled can be fitted. The fitted concave portion 16, similarly to the fitting convex portion 15, is disposed on the center portion of the close-contact portion 12 in the tape front and back direction.

The fitted concave portion 16 is open toward the tip end surface 12*c* of the close-contact portion 12 (facing the corresponding fastener stringer 2). An upper inner wall surface 16*a* and a lower inner wall surface 16*b* are disposed in the fitted concave portion 16 to face each other in the upper and lower direction, and are disposed in the taper shape inclined in the tape width direction with respect to the tape surface of the fastener tape 7 so that the width of a groove serving as the gap between the upper and lower inner wall surfaces 16*a* and 16*b* decreases gradually over a range from the opened tip end surface 12*c* to the fastener tape 7 (see FIG. 8).

In this case, the groove width of the fitted concave portion 16 and the inclination angles of the upper and lower inner wall surfaces 16*a* and 16*b* with respect to the tape surface are set to correspond to the height of the fitting convex portion 15 in the upper and lower direction and the inclination angles of the upper and lower surfaces 15*a* and 15*b* with respect to the tape surface so that the upper inner wall surface 16*a* and the lower inner wall surface 16*b* of the fitted concave portion 16 and the upper surface 15*a* and the lower surface 15*b* of the corresponding fitting convex portion 15 to be coupled come in close contact with each other when the fitting convex portion 15 of the corresponding fastener element 10 to be coupled is fitted in the fitted concave portion 16.

Figure 5:
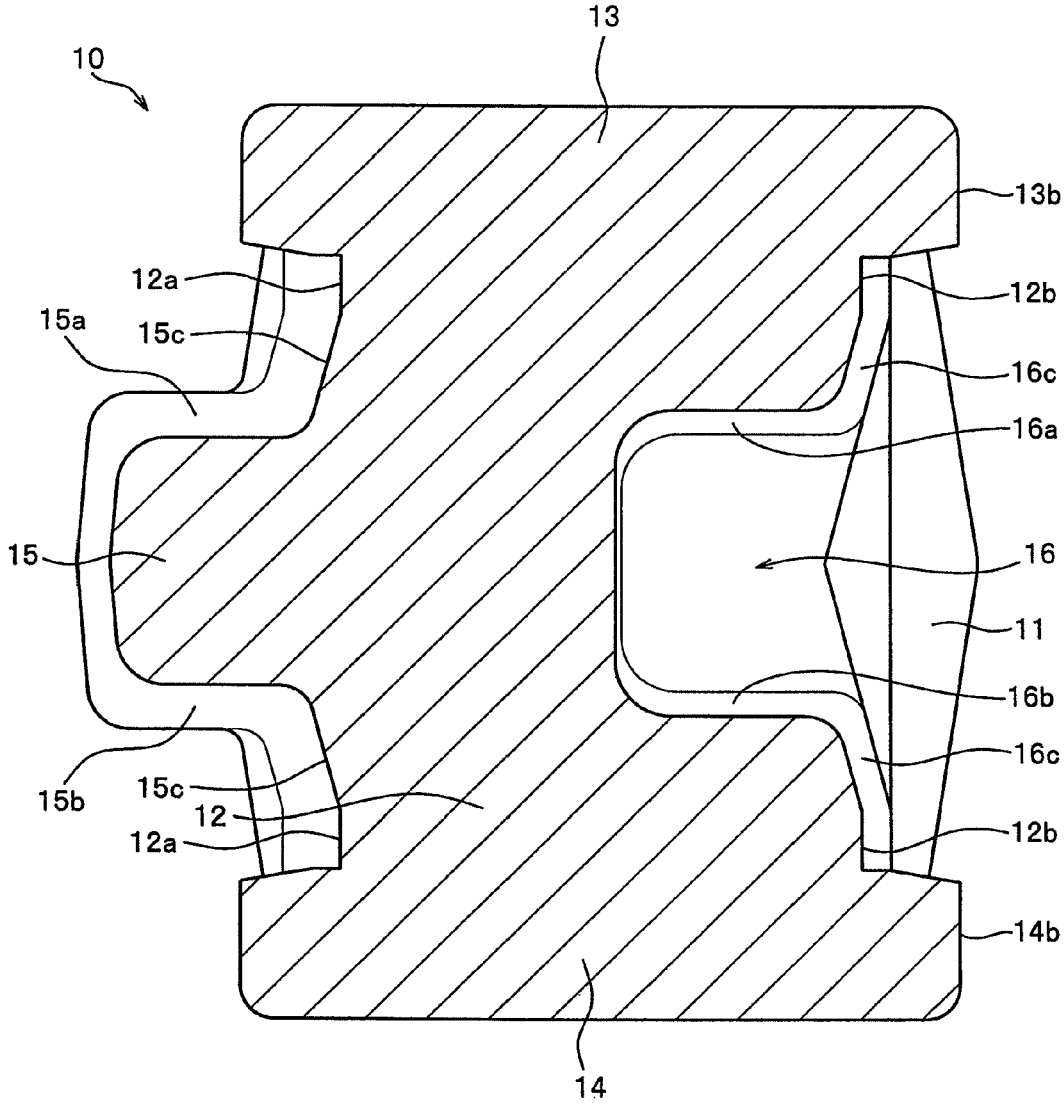
FIG. 5 is a cross-sectional view taken along line V-V depicted by an arrow in FIG. 3.
Figure 6:
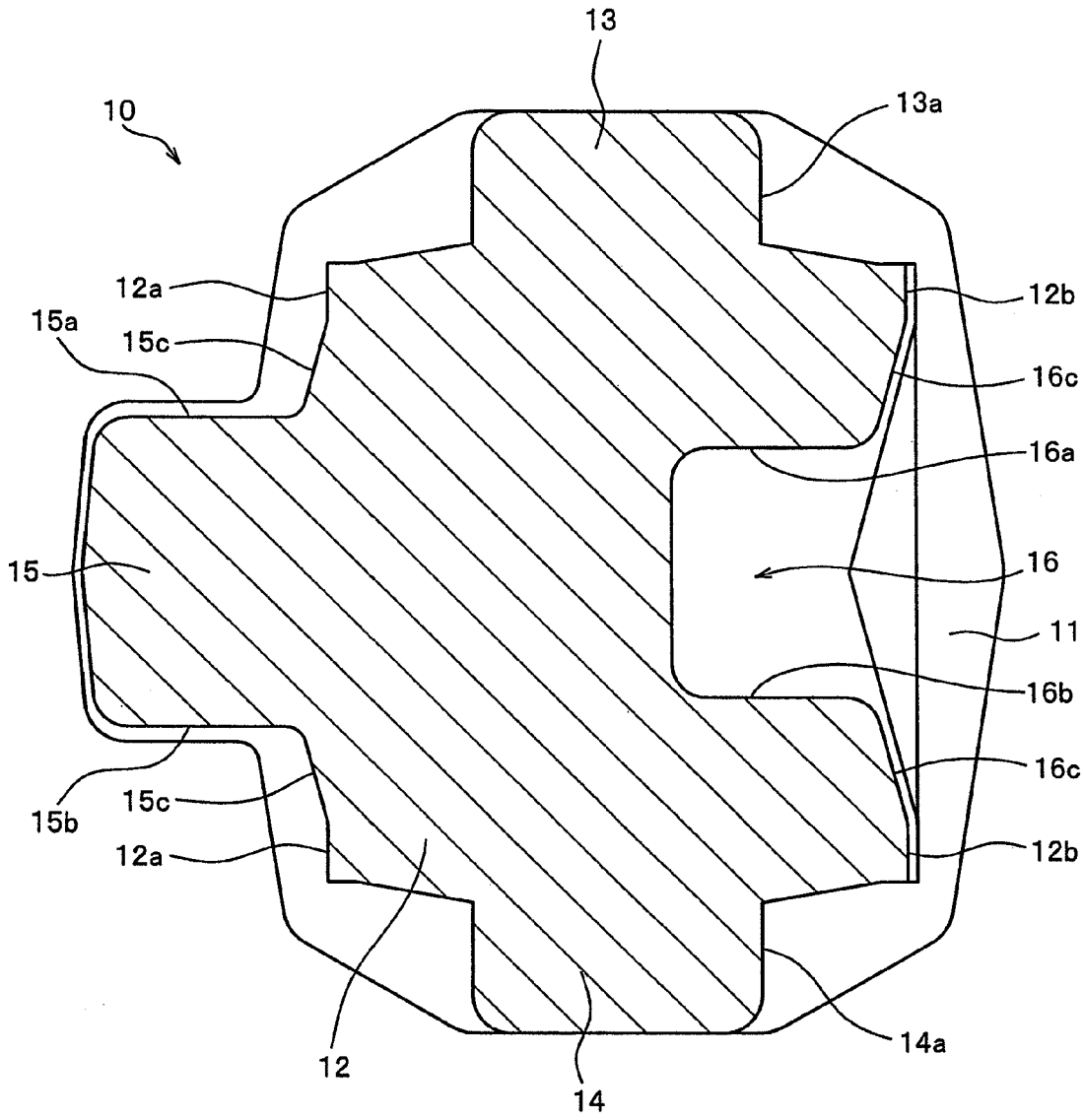
FIG. 6 is a cross-sectional view taken along line VI-VI depicted by an arrow in FIG. 3.

Furthermore, in an opening which is formed on a portion of the second close-contact surface 12*b* of the fitted concave portion 16 according to Embodiment 1, as illustrated in FIGS. 5 and 6, an introduction portion 16*c* is disposed in a form of a substantially rounded surface shape, formed in such a way as to chamfer sharp corners, over a range from the upper and lower inner wall surfaces 16*a* and 16*b* of the fitted concave portion 16 to the second close-contact surface 12*b* so that the fitting convex portion 15 of the corresponding fastener element 10 to be coupled is easily introduced into the fitted concave portion 16. The introduction portion 16*c* is provided such that the groove width in the back and front direction of the tape is widened (in the rear direction) as it goes near the second close-contact surface 12*b*.

In this case, referring to the relation between the introduction portion 16*c* disposed in the fitted concave portion 16 and the root portion 15*c* of the corresponding fitting convex portion 15 to be coupled, the groove width of the introduction portion 16*c* in the tape front and back direction is set to be smaller than the height (a dimension in the tape front and back direction) at a position corresponding to the root portion 15*c* of the corresponding fitting convex portion 15 to be coupled so that the introduction portion 16*c* of the fitted concave portion 16 receives a pressure to be outstretched in the upper and lower direction through the root portion 15*c* of the corresponding fitting convex portion 15 to be coupled when the left and right fastener elements 10 are coupled to fit the corresponding fitting convex portion 15 to be coupled into the fitted concave portion 16.

The first and the second engaging/disengaging portions 13 and 14 of the fastener element 10 according to Embodiment 1 are disposed such that the portions facing the upper and lower surfaces side of the close-contact portion 12 are symmetric so as to extend from the base 11 to the corresponding fastener stringer 2. In addition, the first and the second engaging/disengaging portions 13 and 14 are continuously formed from the base 11, and is provided with neck portions 13*a* and 14*a* which have a shape narrowing in the tape length direction and coupling heads 13*b* and 14*b* which are formed to expand from the neck portions 13*a* and 14*a* in the tape length direction and have a substantially elliptical shape. In this case, the upper surface and the lower surface of the close-contact portion 12 of the fastener element 10 are partially exposed from the neck portions 13*a* and 14*a* of the first and the second engaging/disengaging portions 13 and 14.

With this configuration, when the left and right fastener elements 10 are coupled, the coupling heads 13*b* and 14*b* of the fastener element 10 disposed on the corresponding fastener stringer 2 of the other side can be made to be coupled between the neck portions 13*a* and 14*a* of the adjacent fastener elements 10 disposed on one of the fastener stringers 2. Further, it is possible to make the upper surfaces and the lower surfaces of the close-contact portions 12, which are exposed from the neck portions 13*a* and 14*a* of the respective fastener elements 10, come in contact with the rear surfaces of the corresponding coupling heads 13*b* and 14*b* to be coupled.

Further, in Embodiment 1, the rear surfaces of the coupling heads 13*b* and 14*b* of the first and the second engaging/disengaging portions 13 and 14 of each fastener element 10 may be formed with an inclination such that the heights of the coupling heads 13*b* and 14*b* in the tape front and back direction decrease gradually as it goes from the first close-contact surface 12*a* forward and from the second close-contact surface 12*b* backward. With this configuration, the gap between the rear surface of the coupling head 13*b* of the first engaging/disengaging portion 13 and the rear surface of the coupling head 14*b* of the second engaging/disengaging portion 14 can increase as it goes away from the first and the second close-contact surfaces 12*a* and 12*b*.

Furthermore, in this case, the upper surface and the lower surface of the close-contact portion 12 which are exposed from the neck portions 13*a* and 14*a* may be formed with an inclination such that the height of the close-contact portion 12 increases gradually as it goes from the first and the second close-contact surfaces 12*a* and 12*b* to the inside of the element. With this configuration, when the left and right fastener elements 10 are coupled, the close-contact portion 12 exposed from the neck portions 13*a* and 14*a* of the fastener element 10 can be smoothly inserted between the coupling head 13*b* of the first engaging/disengaging portion 13 of the corresponding fastener element 10 to be coupled and the coupling head 14*b* of the second engaging/disengaging portion 14.

According to the fastener element 10 of Embodiment 1 having the above-mentioned shape, the injection molding of fastener element 10 can be performed with ease and efficiency without a problem on an undercut portion, for example, using an upper mold, a lower mold, and a slide core which is disposed on a portion of the coupling heads 13*b* and 14*b* when the fastener element 10 is formed in the fastener tape 7 through the injection molding.

In addition, in Embodiment 1, the attachment pitch of the fastener elements 10 forming the left and right element rows 3 is set to be smaller than the sum of a dimension D1 between the first and the second close-contact surfaces 12*a* and 12*b* at a predetermined portion of the fastener element 10 and a dimension D2 between the first and the second close-contact surfaces 12*a* and 12*b* at the corresponding portion of the corresponding fastener element 10 to be coupled, so that the gap between the respective fastener elements 10 of the left and right element rows 3 in the coupled state is widened more than the attachment pitch.

Specifically in this case, the ratio of the attachment pitch of the fastener element 10 to the sum of the dimension D1 of the fastener element 10 and the dimension D2 of the corresponding fastener element 10 to be coupled is changed according to the magnitudes of the elongation and the elongation elastic modulus of the fastener tape 7 (specifically, the core thread portion 7*c*); for example, it is preferably set to a range of 95% or more and 99% or less.

With this configuration, as to be described below, when the left and right element rows 3 are coupled, the close-contact portion 12 of each fastener element 10 can come into press contact pressed between the close-contact portions 12 of the adjacent corresponding fastener element 10 to be coupled, using the retractility of the fastener tape 7. Further, a predetermined portion of the fastener element 10 refers to a portion of the fastener element 10 at an arbitrary position in the tape width direction. A corresponding portion of the corresponding fastener element 10 to be coupled refers to a portion of the corresponding fastener element 10 to be coupled at a position in the tape width direction which is the same direction as the predetermined portion when the left and right fastener elements 10 are coupled.

Figure 11:
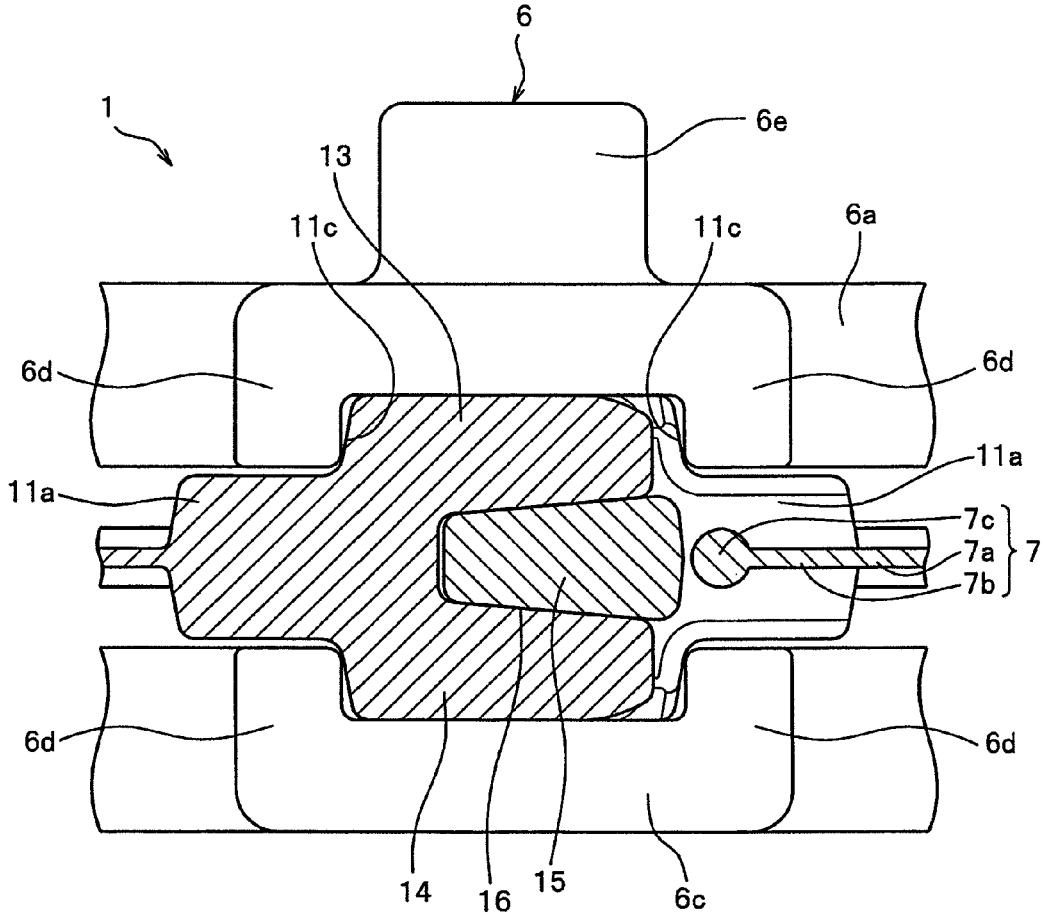
FIG. 11 is a schematic view illustrating a relation between the left and right fastener elements after being coupled and a slider.

The slider 6 used in Embodiment 1 includes a slider body 6*a* and a tab (not illustrated) which is rotatably attached to the slider body 6*a*. In addition, the slider body 6*a*, as illustrated in FIGS. 1 and 11, includes an upper wing plate 6*b*, a lower wing plate 6*c*, a guide post (not illustrated) which connects one end portions of the upper and lower wing plates 6*b* and 6*c*, a flange 6*d* which is connected in tandem to go near each other from the left and right end edges of the upper and lower wing plates 6*b* and 6*c*, and a tab attachment pole 6*e* which is erected on the upper surface of the upper wing plate 6*b* for the attachment of the tab. An element guide path in a substantial Y shape is disposed to guide the fastener element 10 between the upper and lower wing plates 6*b* and 6*c*.

The slider 6 is configured such that, when sliding along the left and right element rows 3, the flange 6*d* of the slider 6 passes along portions of the upper surface and the lower surface of the first base 11*a* of the fastener element 10, and the inner wall surface on a portion of the element guide path of the flange 6*d* comes into sliding contact with the Stepped portion 11*c* which is disposed between the first and the second bases 11*a* and 11*b* of the fastener element 10.

In this case, the gap between the inner surface of the upper wing plate 6*b* and the inner surface of the lower wing plate 6*c* of the slider 6 is set to be larger than a chain thickness of the sliding fastener 1, that is, the height (a dimension in the tape front and back direction) from the upper surface of the first engaging/disengaging portion 13 to the lower surface of the second engaging/disengaging portion 14 of the fastener element 10.

In addition, formed between the upper flange 6*d* connected in tandem from the upper wing plate 6*b* and the lower flange 6*d* connected in tandem from the lower wing plate 6*c* of the slider 6, the width of the tape insertion groove is set to be larger than the height of the first base 11*a* of the fastener element 10 and to be smaller than the chain thickness of the sliding fastener 1. With this configuration, it is possible to make the size of the slider 6 decrease with respect to the chain width of the sliding fastener 1 (a dimension of the left and right fastener elements 10 in the tape width direction at the time of coupling).

Figure 9:
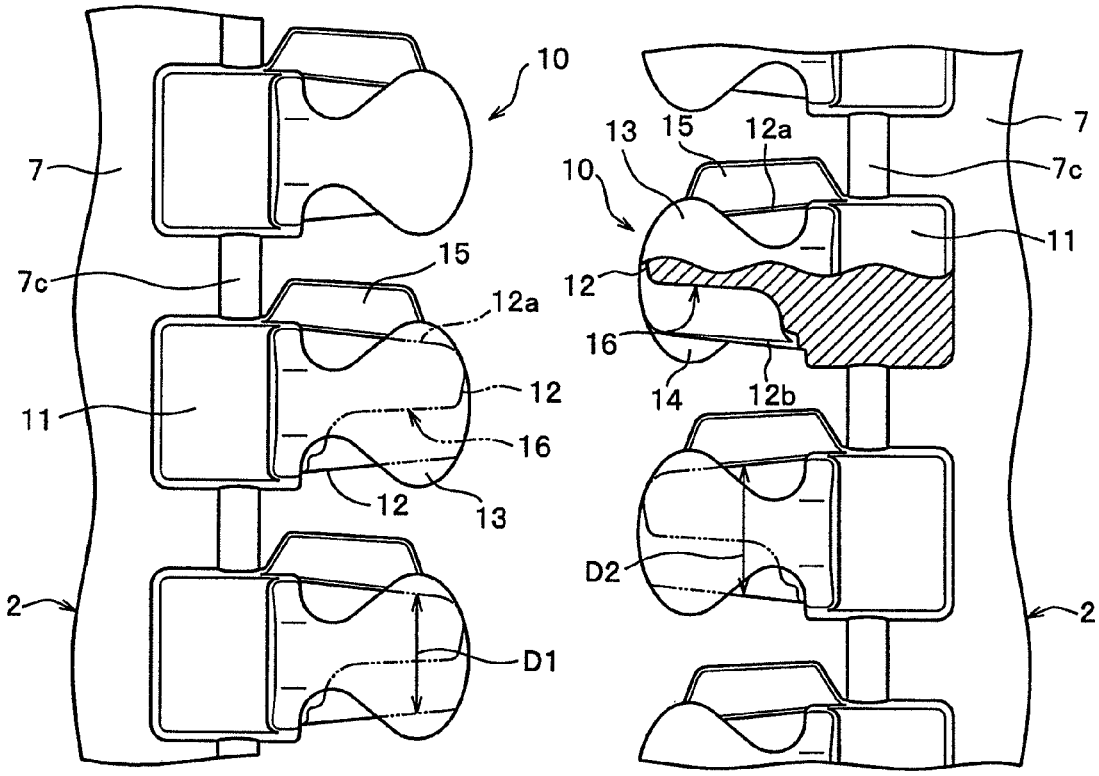
FIG. 9 is an enlarged view illustrating left and right element rows before being coupled with each other.

The sliding fastener 1 of Embodiment 1 with the configuration as described above, in a case where the left and right element rows 3 is separated as illustrated in FIG. 9, the fastener elements 10 are merely adhered to the fastener tape 7 at a predetermined pitch. Therefore, the original flexibility of the fastener tape 7 is secured, so that it is possible to freely bend the fastener stringer 2, for example, in the back and front direction of the tape.

On the other hand, in a case where the left and right element rows 3 of the sliding fastener 1 are coupled, the slider 6 slides from the portion of the separable-inserting bottom end stop 5 toward the top stop 4. Therefore, the first and the second engaging/disengaging portions 13 and 14 are coupled to each other between the left and right fastener elements 10 to couple the left and right fastener elements 10. In addition, the fitting convex portion 15 of each fastener element 10 is inserted and fitted into the fitted concave portion 16 of the corresponding fastener element 10 to be coupled, and at the same time the first close-contact surface 12*a* of each fastener element 10 comes into press contact with the second close-contact surface 12*b* of the corresponding fastener element 10 to be coupled.

In this case, since the first and the second close-contact surfaces 12*a* and 12*b* of the close-contact portion 12 of the fastener element 10 is formed in the taper shape to make the dimension of the close-contact portion 12 in the tape length direction increase gradually as it goes to the fastener tape 7 as described above, when the left and right fastener elements 10 are coupled, it is possible to smoothly insert the close-contact portion 12 of the fastener element 10 between the close-contact portions 12 of the adjacent corresponding fastener elements 10 to be coupled, and interference between the left and right close-contact portions 12 can be prevented.

Figure 7:
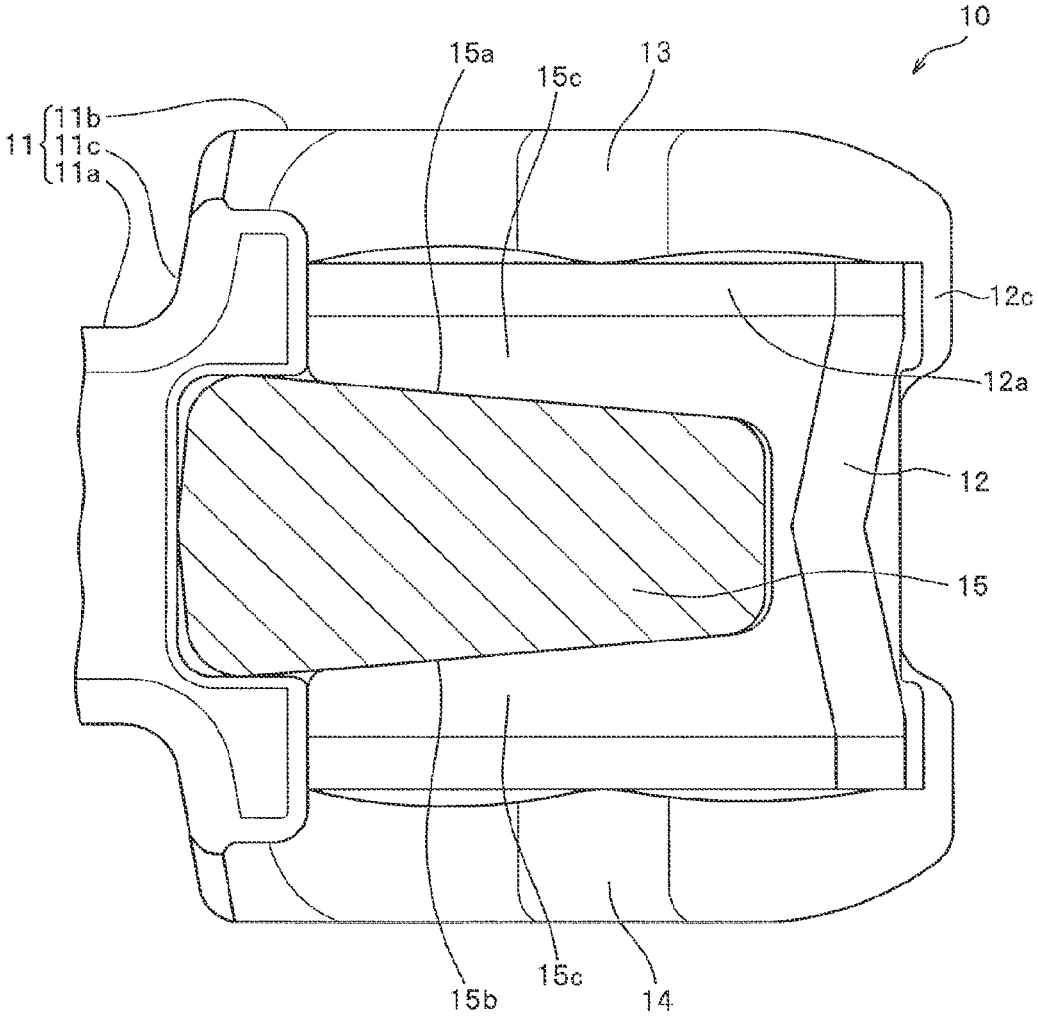
FIG. 7 is a cross-sectional view taken along line VII-VII depicted by an arrow in FIG. 3.
Figure 8:
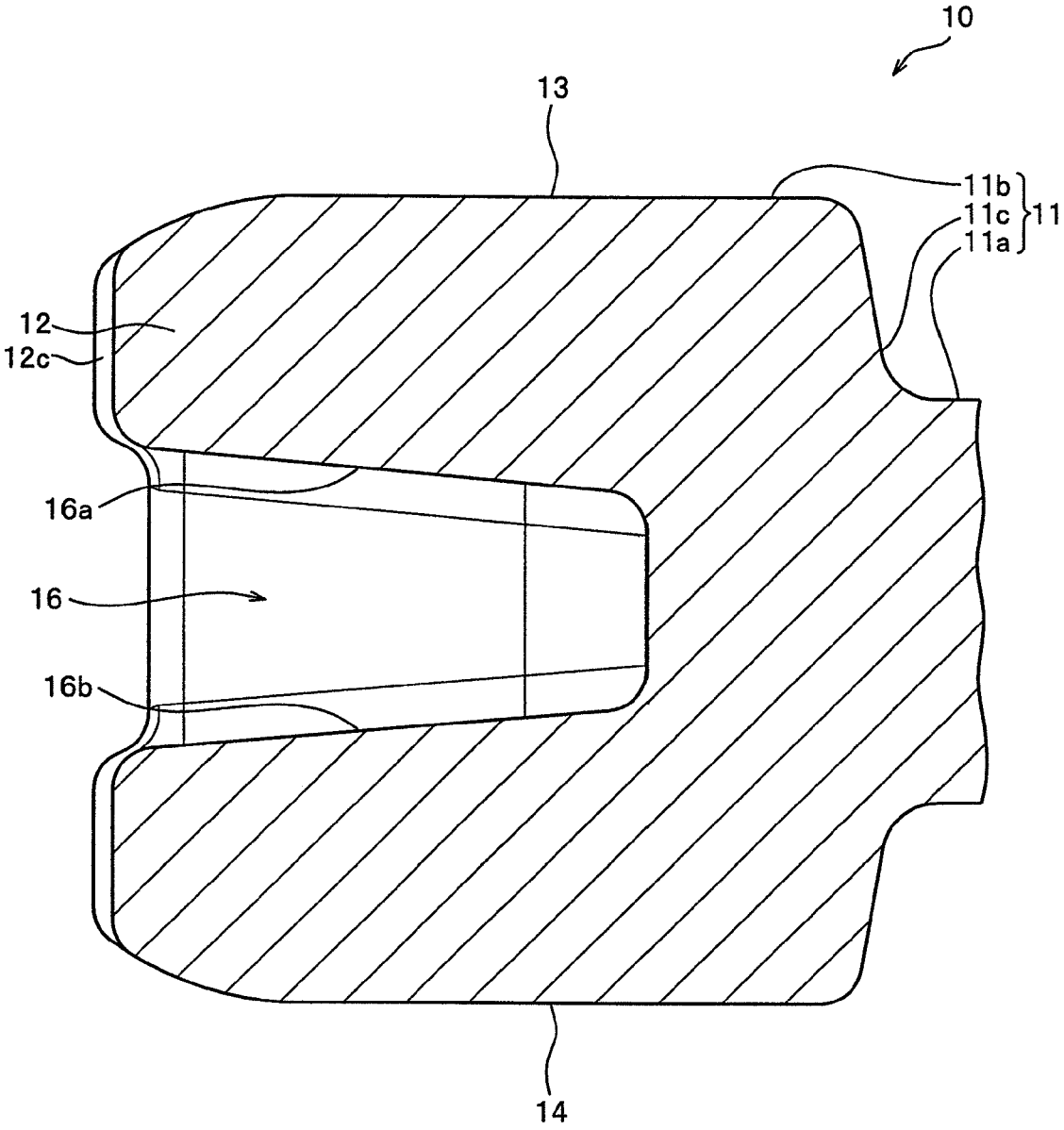
FIG. 8 is a cross-sectional view taken along line VIII-VIII depicted by an arrow in FIG. 3.

In addition, each fastener element 10 is formed such that, as illustrated in FIG. 7, the height of the fitting convex portion 15 increases gradually as it goes to the fastener tape 7 so as to make the tip end portion of the fitting convex portion 15 taper relatively. Furthermore, as illustrated in FIG. 8, the groove width of the fitted concave portion 16 decreases gradually as it goes to the fastener tape 7. The opening of the fitted concave portion 16 formed on a portion of the tip end surface 12*c* of the close-contact portion 12 becomes wider in the tape front and back direction than the tip end portion of the corresponding fitting convex portion 15 to be coupled. Then, the opening of the fitted concave portion 16 formed on a portion of the second close-contact surface 12*b* is provided with the introduction portion 16*c* which is formed in the rounded surface shape as described above.

With this configuration, when the left and right fastener elements 10 are coupled, the fitting convex portion 15 of the fastener element 10 can be smoothly inserted and fitted into the fitted concave portion 16 of the corresponding fastener element 10 to be coupled.

As described above, when the fitting convex portion 15 is fitted into the fitted concave portion 16, since the gap between the upper and lower inner wall surfaces 16*a* and 16*b* inside the fitted concave portion 16 is set to correspond to the height of the fitting convex portion 15 in the upper and lower direction, the upper surface 15*a* and the lower surface 15*b* of the fitting convex portion 15 can stably come into close contact with the upper inner wall surface 16*a* and the lower inner wall surface 16*b* of the fitted concave portion 16. In addition, since the groove width of the introduction portion 16*c* of the fitted concave portion 16 is set to be smaller than the height of the root portion 15*c* of the corresponding fitting convex portion 15 to be coupled, the root portion 15*c* of the corresponding fitting convex portion 15 to be coupled can come into press contact with the introduction portion 16*c* of the fitted concave portion 16.

Figure 10:
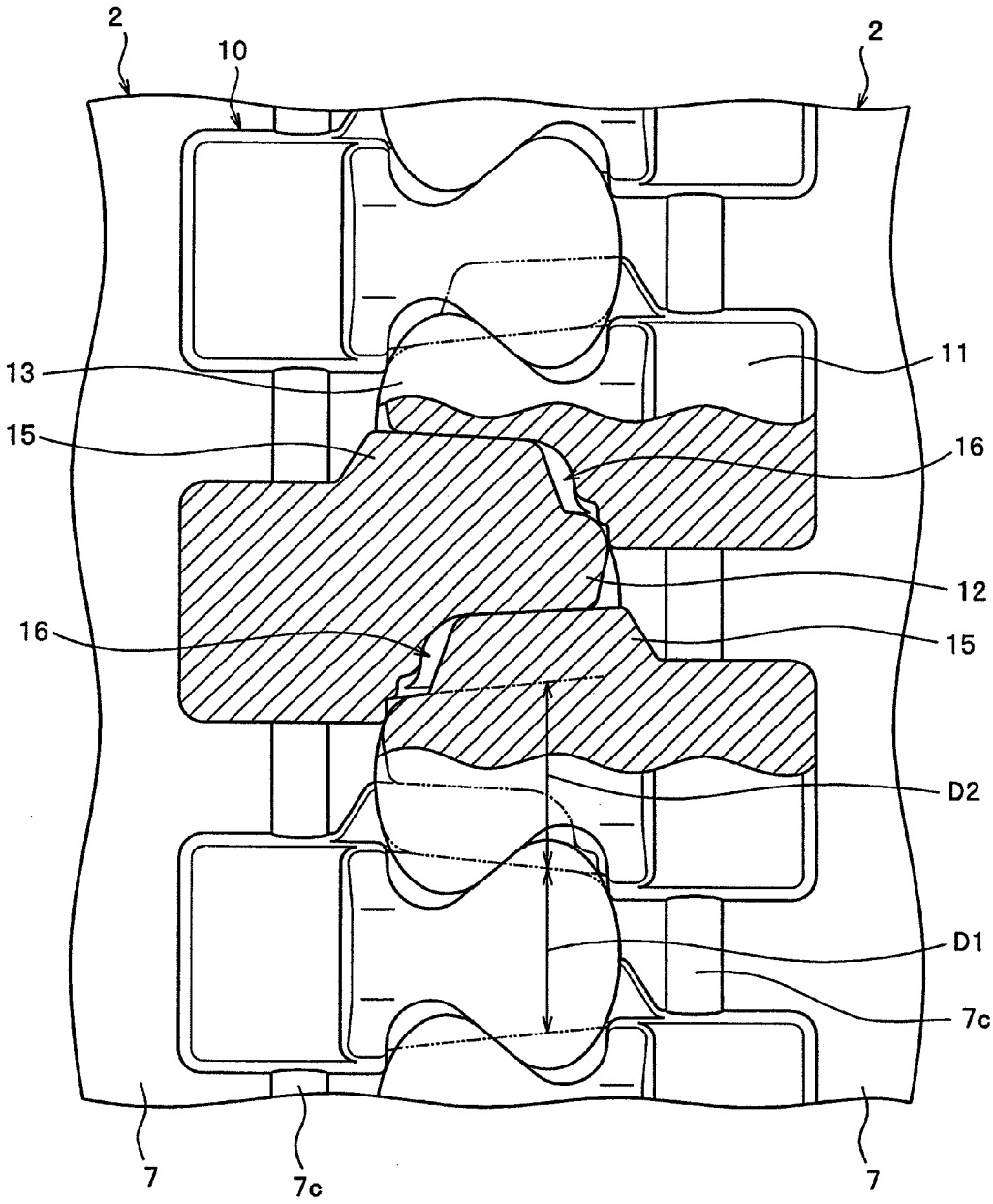
FIG. 10 is a schematic view illustrating the state of the left and right fastener elements after being coupled.
Figure 12:
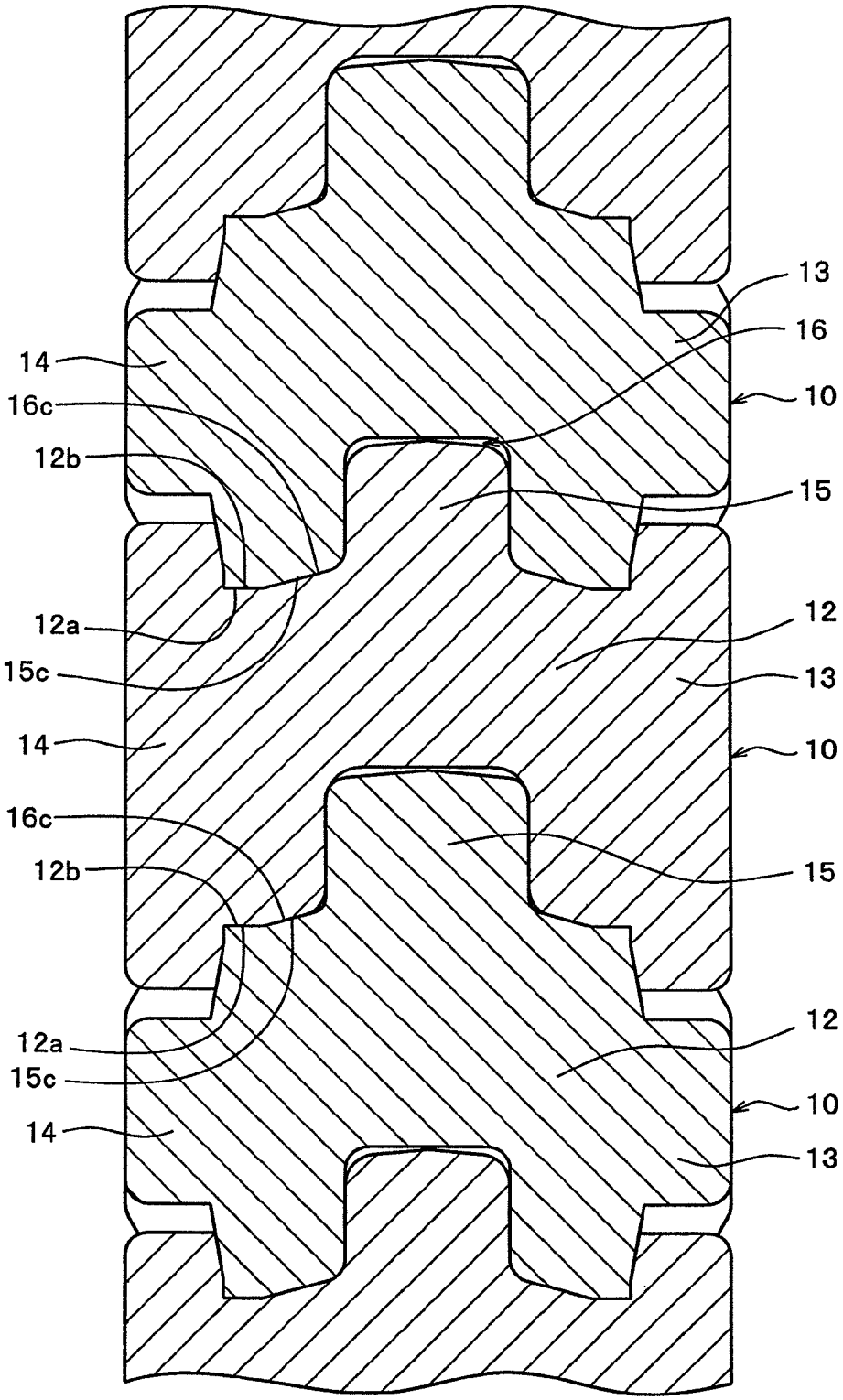
FIG. 12 is a cross-sectional view illustrating the left and right fastener elements after being coupled.

Furthermore, since the fitting convex portion 15 of the fastener element 10 is fitted into the fitted concave portion 16 of the corresponding fastener element 10 to be coupled, as illustrated in FIGS. 10 and 12, when the first close-contact surface 12*a* (or the second close-contact surface 12*b*) of the close-contact portion 12 comes into press contact with the second close-contact surface 12*b* (or the first close-contact surface 12*a*) of the corresponding close-contact portion 12 to be coupled, apart of the front end surface of the fitting convex portion 15 can come in close contact with the bottom surface of the corresponding fitted concave portion 16 to be coupled.

With this configuration, the mutual movement of the left and right fastener elements 10 is regulated to prevent the element row 3 from being bent in the upper and lower direction and the left and right direction, so that the coupled element rows 3 can be made rigid in a line. Further, in the invention, as long as the first and the second close-contact surfaces 12*a* and 12*b* of the close-contact portion 12 of each fastener element 10 can come in close contact with the close-contact portion 12 of the corresponding fastener element 10, the front end surface of the fitting convex portion 15 may not necessarily come in close contact with the bottom surface of the corresponding fitted concave portion 16 to be coupled.

Specifically, in the sliding fastener 1 of Embodiment 1, as described above, the attachment pitch of the fastener element 10 is set to be smaller than the sum of the dimension D1 between the first and the second close-contact surfaces 12*a* and 12*b* at the predetermined portion of the fastener element 10 and the dimension D2 between the first and the second close-contact surfaces 12*a* and 12*b* on the corresponding portion of the corresponding fastener element 10 to be coupled. Furthermore, as described above, the fastener tape 7 including the core thread portion 7*c* is configured using the fiber thread having less retractility.

With this configuration, through the coupling of the left and right element rows 3, the gap between the adjacent fastener elements 10 is forcingly widened by the corresponding fastener element to be coupled, so that the fastener tape 7 expands in the tape length direction, and at the same time an elastic force is applied to the fastener tape 7 to make it shrink back to the original length.

Therefore, since the close-contact portions 12 of the left and right fastener elements 10 come into press contact with each other strongly and thus the first and the second close-contact surfaces 12*a* and 12*b* of each close-contact portion 12 is applied with a strong pressing force (a press-contact force), the left and right element rows 3 can be made rigid in a more firm manner. Accordingly, even though the coupled left and right element rows 3 receives a bending load and a thrusting force, for example, in the tape front and back direction, the rigid state of the element rows 3 in a line can be stably maintained.

In addition, according to the sliding fastener 1 of Embodiment 1, when the left and right element rows 3 are coupled to be made rigid as described above, and then the slider 6 slides toward the separable-inserting bottom end stop 5 to separate the left and right element rows 3, the rigid state of the element rows 3 is released and the left and right fastener stringers 2 can be freely bent again in the tape front and back direction.

The above-mentioned sliding fastener 1 of Embodiment 1 may be preferably used, for example, in a strut portion of a tent. In the case of the tent using the sliding fastener 1, the element rows 3 are made rigid in a more firm manner and thus the tent is set up with high stability through the coupling of the left and right element rows 3 by closing the sliding fastener 1. On the other hand, when the tent is taken down, the flexibility of the left and right fastener stringers 2 is restored through the separation of the left and right element rows 3 by opening the sliding fastener 1, so that the sliding fastener 1 can be easily folded with the tent for storage.

Figure 13:
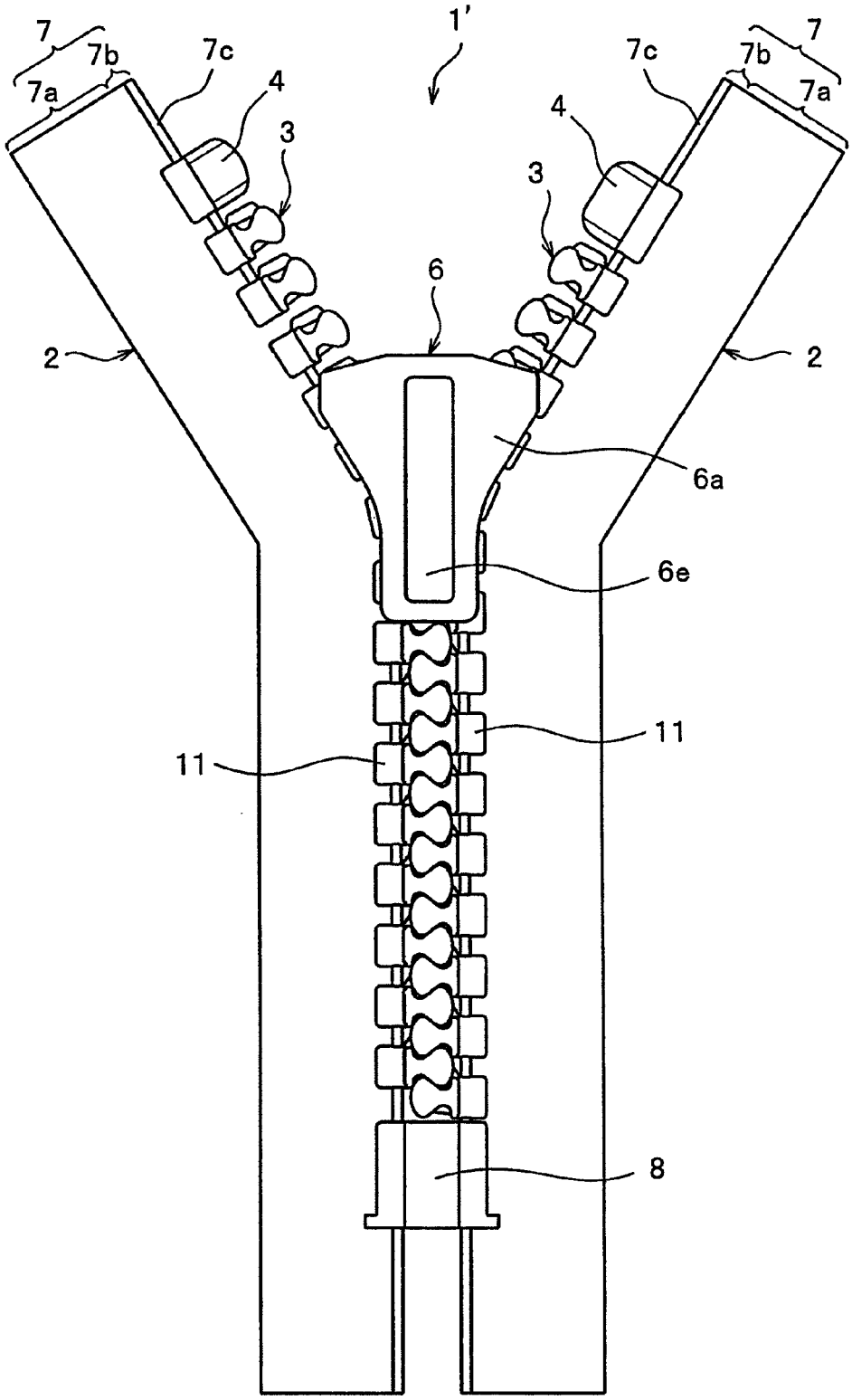
FIG. 13 is a front view illustrating a sliding fastener according to a modified example of Embodiment 1.

Further, according to the sliding fastener 1 of Embodiment 1, the separable-inserting bottom end stop 5 is configured to be adhered to the lower end portion of the left and right fastener stringers 2, but the invention is not limited to the configuration; for example, as illustrated with a sliding fastener 1' according to a modified example of FIG. 13, a bottom stop 8 may be attached to the lower end portion of the left and right fastener stringers 2 instead of the separable-inserting bottom end stop 5. The sliding fastener 1' using the above-mentioned bottom stop 8 can also achieve the same advantageous effects as those of the above-mentioned sliding fastener 1 of Embodiment 1.

Figure 14:
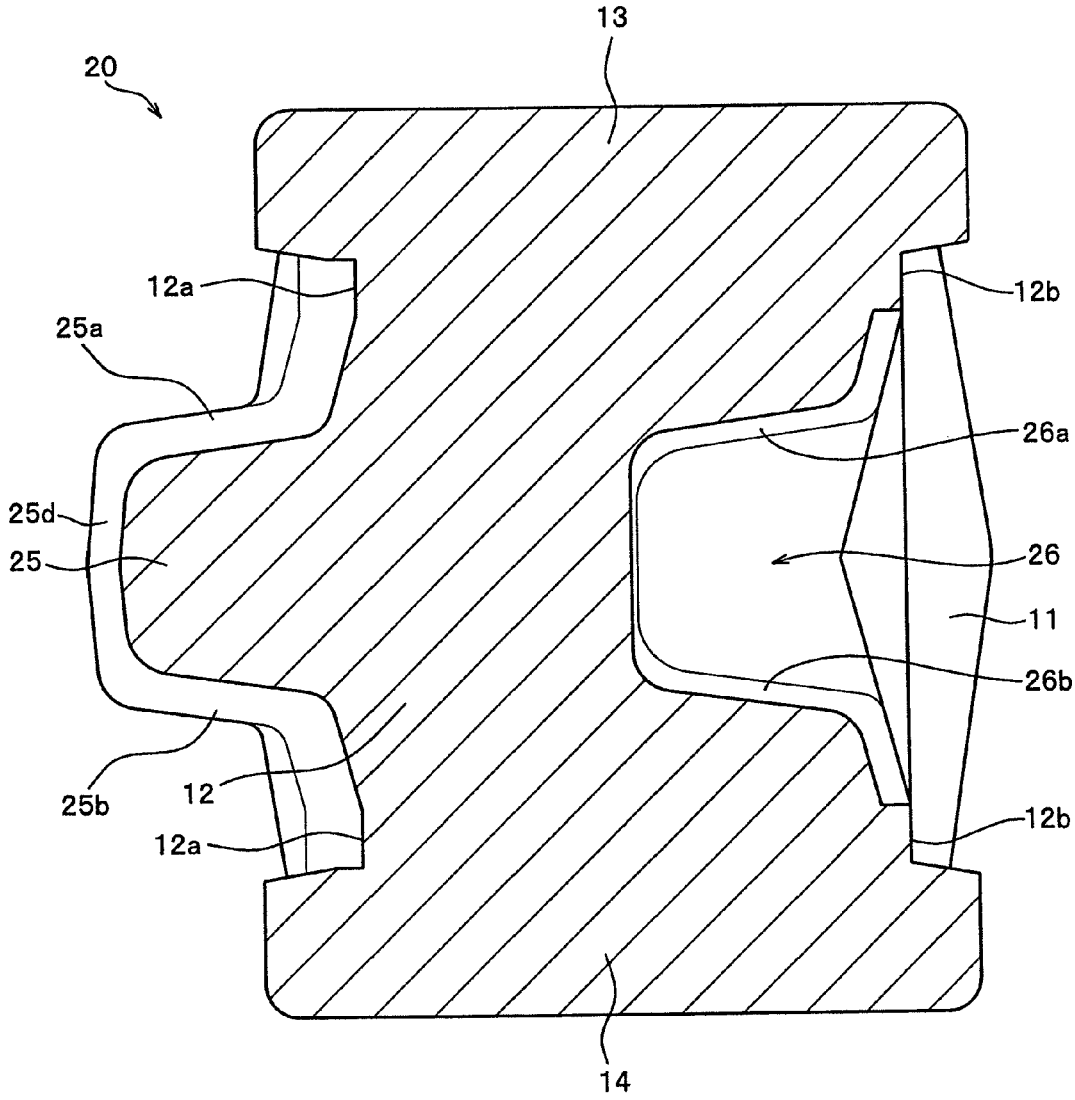
FIG. 14 is a cross-sectional view illustrating a fastener element of a sliding fastener according to another modified example of Embodiment 1.

In addition, according to the sliding fastener 1 of Embodiment 1, the upper surface 15*a* and the lower surface 15*b* of the fitting convex portion 15 and the upper inner wall surface 16*a* and the lower inner wall surface 16*b* of the fitted concave portion 16, which are disposed in each fastener element 10, are formed in the taper shape inclined in the tape width direction with respect to the tape surface of the fastener tape 7 as described above. In this case, for example, as illustrated with a fastener element 20 according to another modified example of FIG. 14, it is possible to be formed in a taper shape in which the upper surface 25*a* and the lower surface 25*b* of a fitting convex portion 25 are formed with an inclination in the tape width direction and the height of the fitting convex portion 25 in the tape front and back direction is inclined also in the tape length direction to decrease gradually as it goes to the front end surface (top surface) 25*d* of the fitting convex portion 25. With this configuration, the height of the front end portion of the fitting convex portion 25 can taper relatively compared with the base end portion.

In addition, a fitted concave portion 26 is formed in the taper shape in which an upper inner wall surface 26*a* and a lower inner wall surface 26*b* are inclined in the tape width direction, and the groove width of the fitted concave portion 26 in the tape front and back direction is inclined also in the tape length direction to decrease gradually as it goes to the bottom surface of the fitted concave portion 26. Therefore, the opening of the fitted concave portion 26 can be widened in the tape front and back direction compared with the height of the front end portion of the corresponding fitting convex portion 25 to be coupled.

With this configuration, when the left and right fastener elements 20 are coupled, the fitting convex portion 25 of the fastener element 20 can be smoothly inserted into the fitted concave portion 26 of the corresponding fastener element 20 to be coupled.

Specifically in this case, the groove width of the fitted concave portion 26 is preferably set to be smaller than the height at a position of the corresponding Fitting convex portion 25 to be coupled and fitted to the fitted concave portion 26. With this configuration, the upper surface 25*a* and the lower surface 25*b* of the corresponding fitting convex portion 25 to be coupled come into contact with the upper inner wall surface 26*a* and the lower inner wall surface 26*b* of the fitted concave portion 26 when the left and right fastener elements 20 are coupled to fit the corresponding fitting convex portion 25 to be coupled into the fitted concave portion 26. Therefore, the left and right fastener elements 20 come into press contact with each other further strongly, and thus the rigid state of the element rows 3 can be strengthened further.

Embodiment 2

Figure 15:
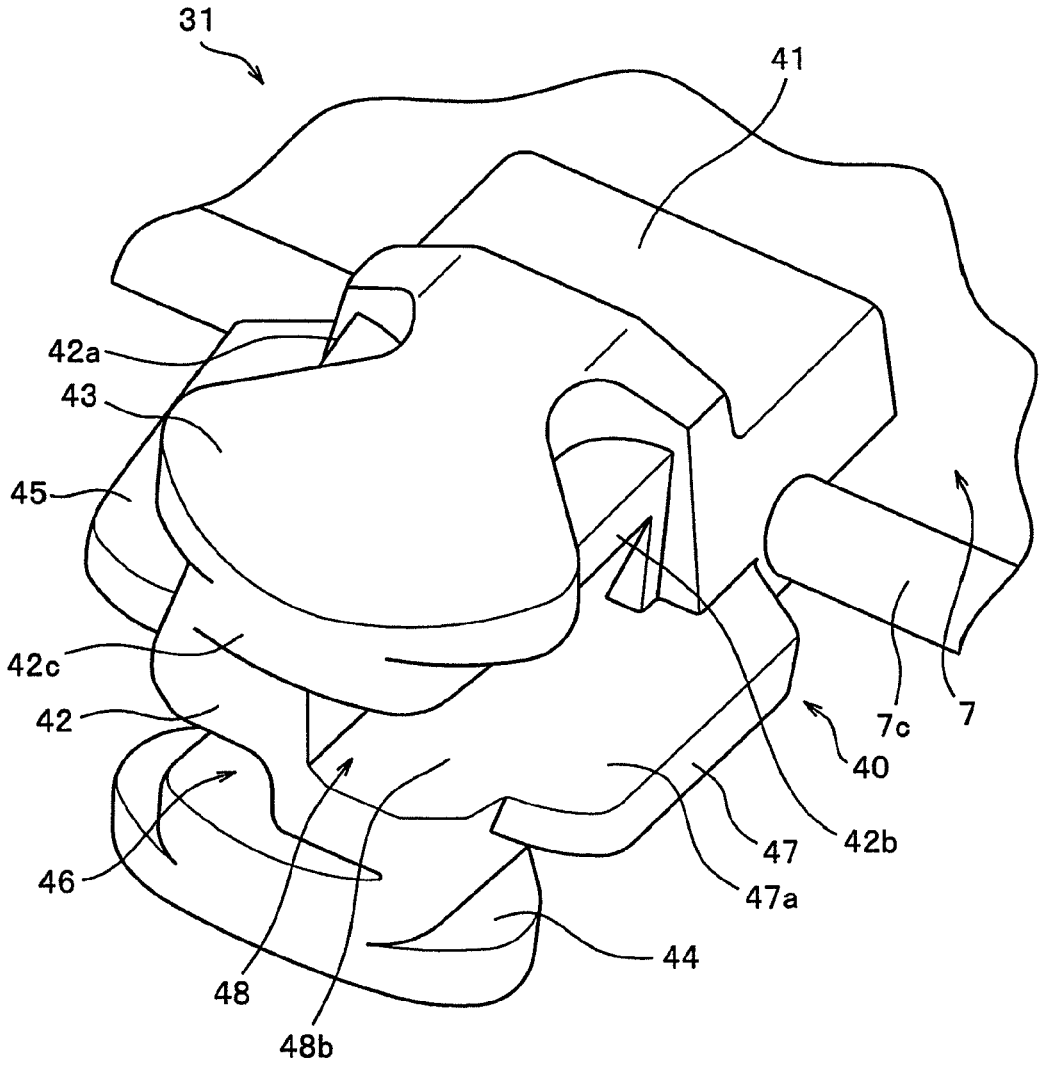
FIG. 15 is a perspective view illustrating a fastener element of a sliding fastener according to Embodiment 2 of the invention.
Figure 16:
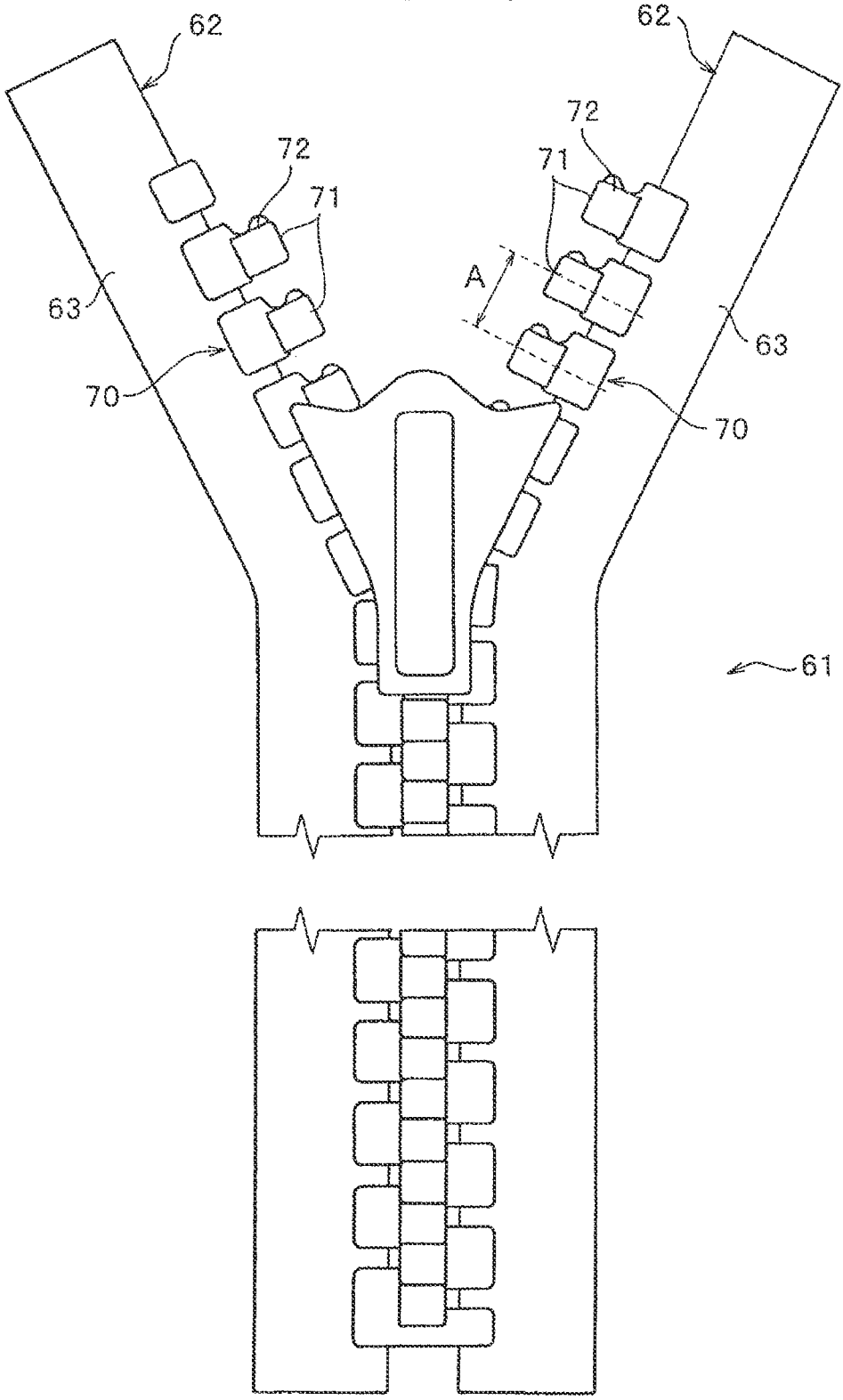
FIG. 16 is a front view illustrating a sliding fastener of the related art.
Figure 17:
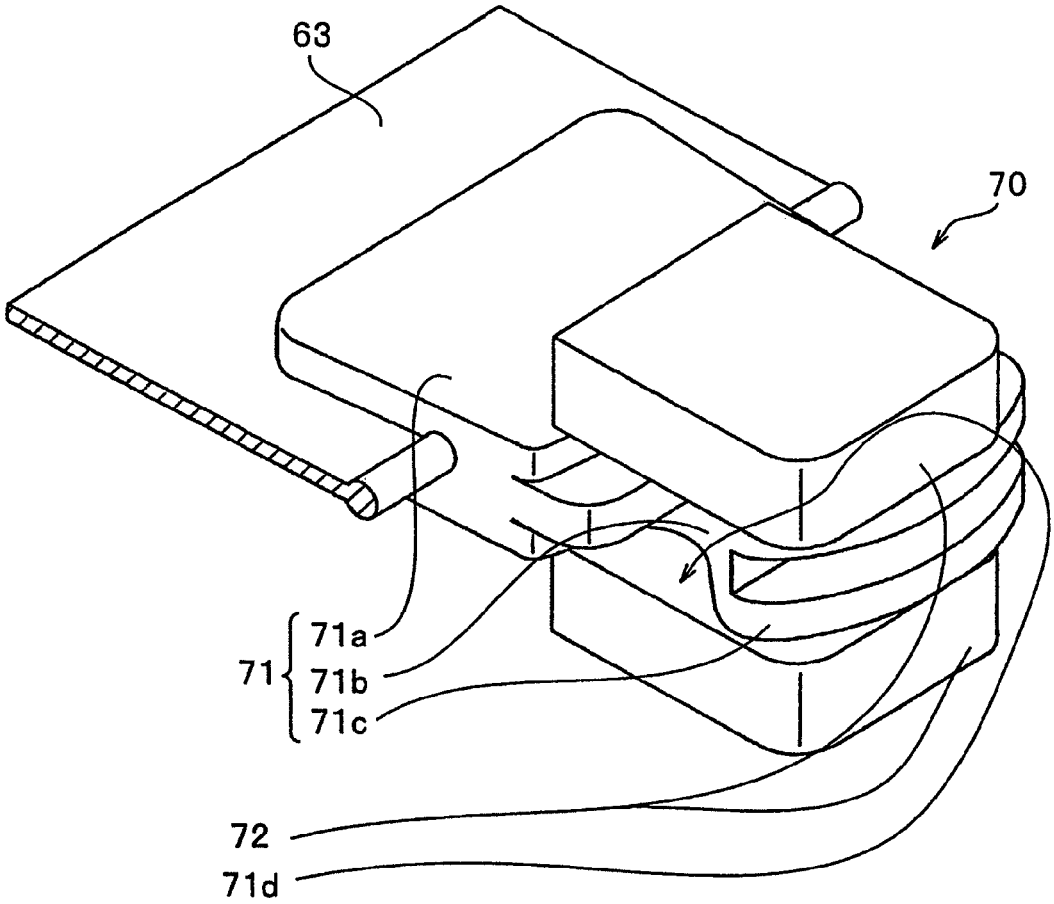
FIG. 17 is a perspective view illustrating a fastener element of the sliding fastener.

FIG. 15 is a perspective view illustrating a fastener element of a sliding fastener according to Embodiment 2.

In a sliding fastener 31 according to Embodiment 2, a first close-contact surface 42*a* and a second close-contact surface 42*b* in a close-contact portion 42 of each fastener element 40 each are provided with fitting convex portions 45 and 47 and fitted concave portions 46 and 48, respectively; and the other components are substantially similar to those of the sliding fastener 1 according to Embodiment 1 described above. Therefore, in Embodiment 2, the configuration of the fastener element 40 will be mainly described, and the members having the similar configurations to those of the sliding fastener 1 of Embodiment 1 described above will be denoted by the same reference numerals and the descriptions will not be provided.

The fastener elements 40 of Embodiment 2 are adhered to the left and right fastener tapes 7 at a predetermined pitch in a plane symmetry direction. Each fastener element 40 includes a base 41 which is integrally fixed to the fastener tape 7, the close-contact portion 42 which extends from the base 41 to the corresponding fastener stringer 2, a first engaging/disengaging portion 43 which is disposed at the upper surface of the close-contact portion 42, and second engaging/disengaging portion 44 which is disposed in the lower surface of the close-contact portion 42. In this case, the base 41 and the first and the second engaging/disengaging portions 43 and 44 of the fastener element 40 are similarly formed to the fastener element 10 of Embodiment 1 described above.

The close-contact portion 42 of the fastener element 40 of Embodiment 2 includes the first close-contact surface 42*a* which is disposed on a portion of a front surface, a second close-contact surface 42*b* which is disposed on a portion of a back surface, and a tip end surface 42*c* which is disposed to face the corresponding fastener stringer 2 and is continuously formed over the range from the first close-contact surface 42*a* to the second close-contact surface 42*b*. In addition, the first and the second close-contact surfaces 42*a* and 42*b* of the close-contact portion 42 are formed on taper surfaces inclined such that the dimension of the close contact portion 42 in the tape length direction increases gradually as it goes to the fastener tape 7.

In the first close-contact surface 42*a* of the close-contact portion 42, a first fitting convex portion 45 is formed to protrude forward, and a first fitted concave portion 46 is formed to be recessively provided backward. In this case, the first fitting convex portion 45 is disposed on the upper side of the first fitted concave portion 46, and the lower surface of the first fitting convex portion 45 is disposed to become flush with the upper inner wall surface of the first fitted concave portion 46.

On the other hand, in the second close-contact surface 42*b* of the close-contact portion 42, there are disposed a second fitted concave portion 48 into which the first fitting convex portion 45 disposed in the first close-contact surface 42*a* of the corresponding fastener element 40 to be coupled can be fitted and a second fitting convex portion 47 which can be fitted into the first fitted concave portion 46 disposed on the first close-contact surface 42*a*. In this case, a second fitted concave portion 48 is disposed on the upper side of the second fitting convex portion 47, and a lower inner wall surface 48*b* of the second fitted concave portion 48 is disposed to become flush with the upper surface 47*a* of the second fitting convex portion 47.

In addition, the upper surface 47*a* and the lower surface of the first and the second fitting convex portions 45 and 47 are formed in the taper shape inclined in the tape width direction with respect to the tape surface of the fastener tape 7 such that the heights of the first and the second fitting convex portions 45 and 47 in the upper and lower direction increase gradually as it goes to the fastener tape 7.

The first and the second fitted concave portions 46 and 48 each are open on a portion of the tip end surface 42*c* of the close-contact portion 42, and are formed in the taper shape inclined in the tape width direction with respect to the tape surface of the fastener tape 7 such that the groove widths of the upper inner wall surface and the lower inner wall surface 48*b* in the first and the second fitted concave portions 46 and 48 decrease gradually as it goes from the opened tip end surface 42*c* to the fastener tape 7.

The fastener element 40 of Embodiment 2 having the above-mentioned shape, similarly to Embodiment 1 described above, the injection molding of the fastener element 40 can be performed with ease and efficiency without a problem on the undercut, for example, using the upper mold, the lower mold, and the slide core which is disposed on a portion of the coupling head when the fastener element 40 is formed on the fastener tape 7 through the injection molding.

In addition, in Embodiment 2, the attachment pitch of the fastener elements 40 forming the left and right element rows 3 is set to be smaller than the sum of a dimension D1 between the first and the second close-contact surfaces 42*a* and 42*b* at a predetermined portion of the fastener element 40 and a dimension D2 between the first and the second close-contact surfaces 42*a* and 42*b* at the corresponding portion of the corresponding fastener element 40 to be coupled, so that the gap between the respective fastener elements 40 of the left and right element rows 3 in the coupled state is widened more than the attachment pitch.

Therefore, the sliding fastener 31 of Embodiment 2 couples the left and right fastener elements 40 by sliding the slider 6, so that the first fitting convex portion 45 of each fastener element 40 is smoothly inserted and fitted into the second fitted concave portion 48 of the corresponding fastener element 40 to be coupled, and the second fitting convex portion 47 of the corresponding fastener element 40 to be coupled is smoothly inserted and fitted into the first fitted concave portion 46 of each fastener element 40. At the same time, it is possible to make the first close-contact surface 42*a* of each fastener element 40 come into press contact with the second close-contact surface 42*b* of the corresponding fastener element 40 to be coupled.

With this configuration, it is possible to make the coupled left and right element rows 3 rigid in a line in a more firm manner. Specifically, in Embodiment 2, the first fitting convex portion 45 of each fastener element 40 is fitted into the corresponding second fitted concave portion 48 to be coupled, and the corresponding second fitting convex portion 47 to be coupled is fitted into the first fitted concave portion 46. Therefore, the element row 3 can be reinforced in the rigid state, and the strength of the element rows 3 can be further improved with respect to the bending load and the thrusting force in the tape front and back direction.

In addition, according to the sliding fastener 31 of Embodiment 2, similarly to Embodiment 1 described above, the rigid state of the element row 3 is released by sliding the slider 6 to separate the left and right element rows 3, so that the original flexibility of the fastener tape 7 is restored and the left and right fastener stringers 2 can be freely bent in the tape front and back direction.

DESCRIPTION OF REFERENCE NUMERALS

1, 1' Sliding fastener
2 Fastener stringer
3 Element row
4 Top stop
5 Separable-inserting bottom end stop
5*a* Insert pin
5*b* Box pin
5*c* Box
6 Slider
6*a* Slider body
6*b* Upper wing plate
6*c* Lower wing plate
6*d* Flange
6*e* Tab attachment pole
7 Fastener tape
7*a* Tape main portion
7*b* Element attaching portion
7*c* Core thread portion
8 Bottom stop
10 Fastener element
11 Base
11*a* First base
11*b* Second base
11*c* Stepped portion
12 Close-contact portion
12*a* First close-contact surface
12*b* Second close-contact surface
12*c* Tip end surface
13 First engaging/disengaging portion
13*a* Neck portion
13*b* Coupling head
14 Second engaging/disengaging portion
14*a* Neck portion
14*b* Coupling head
15 Fitting convex portion
15*a* Upper surface
15*b* Lower surface
15*c* Root portion
16 Fitted concave portion
16*a* Upper inner wall surface
16*b* Lower inner wall surface
16*c* Introduction portion
20 Fastener element
25 Fitting convex portion
25*a* Upper surface
25*b* Lower surface
25*d* Front end surface (top surface)
26 Fitted concave portion
26*a* Upper inner wall surface
26*b* Lower inner wall surface
31 Sliding fastener
40 Fastener element
41 Base
42 Close contact portion
42*a* First close-contact surface
42*b* Second close-contact surface
42*c* Tip end surface
43 First engaging/disengaging portion
44 Second engaging/disengaging portion
45 First Fitting convex portion
46 First Fitted concave portion
47 Second Fitting convex portion
47*a* Upper surface
48 Second Fitted concave portion
48*b* Lower inner wall surface A Pitch D1, D2 Dimension between first and second close-contact surfaces

The invention claimed is:

1. A sliding fastener comprising a pair of left and right fastener stringers which include a plurality of fastener elements adhered to facing tape side edges of a pair of fastener tapes at a predetermined pitch which is an interval between the adjacent elements, wherein the fastener elements on the left and right fastener stringers come in close-contact with each other when the fastener elements are coupled to make the sliding fastener rigid, each fastener element includes a base which is integrally fixed to the fastener tape, a close contact portion which extends from the base towards a corresponding fastener stringer and comes in close contact with a corresponding fastener element at the time of coupling, and a first engaging and disengaging portion and a second engaging and disengaging portion which are disposed integrally on a first tape surface side and a second tape surface side via the close-contact portion and are mutually engageable and disengageable with those of the corresponding fastener element, the close-contact portion includes a first close-contact surface which is disposed on one side in a tape length direction, and a second close-contact surface which is disposed on the other side in the tape length direction, the first and the second close-contact surfaces are tapered surfaces such that a dimension of the close-contact portion in the tape length direction increases gradually from a tip end surface of the close-contact portion toward the fastener tape, and the pitch is set to be smaller than a sum of a dimension between the first and the second close-contact surfaces at a predetermined portion of the fastener element and a dimension between the first and the second close-contact surfaces at a corresponding portion of the corresponding fastener element.

2. The sliding fastener according to claim 1, wherein a fitting convex portion which protrudes in the tape length direction is disposed in the first close-contact surface, and a fitted concave portion, which is fitted by a fitting convex portion of the corresponding fastener element when the fastener elements are coupled, is disposed in the second close-contact surface.

3. The sliding fastener according to claim 2, wherein the fitted concave portion is formed such that a groove width in a tape front and back direction decreases gradually toward the fastener tape, and the fitting convex portion is formed such that a dimension in the tape front and back direction increases gradually toward the fastener tape.

4. A sliding fastener including a pair of left and right fastener stringers comprising a plurality of fastener elements adhered to facing tape side edges of a pair of fastener tapes at a predetermined pitch, wherein the left and right fastener elements come in close contact with each other when the fastener elements are coupled to make the sliding fastener rigid, each fastener element includes a base which is integrally fixed to the fastener tape, a close-contact portion which extends from the base to the corresponding fastener stringer and comes in close contact with a corresponding fastener element at the time of coupling, and a first engaging and disengaging portion and a second engaging and disengaging portion which are disposed integrally on a first tape surface side and a second tape surface side via the close-contact portion and are mutually engageable and disengageable with those of the corresponding fastener element, the close contact portion includes a first close-contact surface which is disposed on a side in a tape length direction, and a second close-contact surface which is disposed on the other side in the tape length direction, the first and the second close-contact surfaces are tapered surfaces such that a dimension of the close contact portion in the tape length direction increases gradually from a tip end surface of the close-contact portion toward the fastener tape, a fitting convex portion which protrudes in the tape length direction is disposed in the first close-contact surface, and a fitted concave portion which is fitted by a fitting convex portion of the corresponding fastener element when the fastener elements are coupled, is disposed in the second close-contact surface.

5. The sliding fastener according to claim 4, wherein the fitted concave portion is formed such that a groove width in a tape front and back direction decreases gradually toward the fastener tape, and the fitting convex portion is formed such that a dimension in the tape front and back direction increases gradually toward the fastener tape.

* * * * *